US007717318B2

(12) United States Patent
Brand

(10) Patent No.: US 7,717,318 B2
(45) Date of Patent: May 18, 2010

(54) COOLER CARTON

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/503,160

(22) Filed: Jul. 15, 2009

(65) Prior Publication Data

US 2009/0308915 A1 Dec. 17, 2009

Related U.S. Application Data

(63) Continuation of application No. PCT/US2008/000716, filed on Jan. 18, 2008.

(60) Provisional application No. 60/881,286, filed on Jan. 19, 2007.

(51) Int. Cl.
*B65D 17/28* (2006.01)
*B65D 5/355* (2006.01)

(52) U.S. Cl. ..... 229/101; 53/491; 229/243; 229/244; 493/162; 493/183

(58) Field of Classification Search ..... 229/101, 229/101.2, 243, 244, 240, 241, 242; 493/128, 493/162, 183; 53/491; 206/427
See application file for complete search history.

(56) References Cited

U.S. PATENT DOCUMENTS 2,810,506 A * 10/1957 Kessler ..... 229/101
3,176,904 A * 4/1965 Collura ..... 229/137
(Continued)

FOREIGN PATENT DOCUMENTS

GB 2235433 A * 3/1991 ..... 229/243
(Continued)

*Primary Examiner*—Gary E Elkins
(74) *Attorney, Agent, or Firm*—Womble Carlyle Sandridge & Rice, PLLC

(57) ABSTRACT

A cooler carton for items such as beverage containers is erected from a blank (11) having a unique configuration of panels (12, 13, 14, 16, 17, 41, 47, 56, 66, 96, 99), tabs (28, 29, 31, 32), flaps (111), creases (18, 19, 21, 22, 33, 34, 36, 37, 42, 48, 57, 67, 77, 87), perforations (23, 26, 27), cut-creases (24, 97, 101), and gussets (46, 52, 81, 91). The erected carton has top panels (12, 17) forming a top with a central longitudinal perforation line (23, 26) and oblique cut-creases and perforation lines (24, 27) extending from the ends of the central perforation line (23, 26) to the corners of the top. Flaps (111) are formed at respective end portions of the top by folded tabs (28, 29, 31, 32). In use, the carton is erected and filled with articles to be contained. An end user may open the carton by pulling up and back on the flaps (111) at the end portions of the top, which severs the oblique cut-creases and perforation lines (23, 26), and severs the top along its central perforation line (23, 26). As a result, the top opens up and forms a containment skirt that extends above the level of beverage containers in the carton. Ice can then be added atop the containers to cool their contents and the ice is contained by the skirt. Gussets (46, 52, 81, 91) are formed at the lower corner portions of the carton, which, along with a moisture barrier, prevent accumulated water from melting ice from leaking from the bottom region of the carton.

15 Claims, 26 Drawing Sheets

U.S. PATENT DOCUMENTS

| | | | | | |
|---|---|---|---|---|---|
| 3,355,089 | A | * | 11/1967 | Champlin | 229/243 |
| 3,886,901 | A | * | 6/1975 | Zeitter | 229/101 |
| 5,094,359 | A | * | 3/1992 | DeMars et al. | 229/101 |
| 5,101,642 | A | * | 4/1992 | Alexandrov | 62/371 |
| 5,303,863 | A | * | 4/1994 | Arasim | 229/101 |
| 5,307,986 | A | * | 5/1994 | Schuster | 229/244 |
| 5,582,343 | A | * | 12/1996 | Dalvey | 229/101 |
| 6,945,450 | B2 | * | 9/2005 | Rusnock | 229/243 |
| 7,611,042 | B2 | * | 11/2009 | Bates et al. | 229/101 |
| 2005/0167478 | A1 | * | 8/2005 | Holley, Jr. | 229/243 |
| 2007/0051781 | A1 | * | 3/2007 | Holley, Jr. | 229/101 |
| 2007/0164091 | A1 | * | 7/2007 | Fogle et al. | 229/101 |
| 2007/0284424 | A1 | * | 12/2007 | Holley | 229/101 |
| 2009/0277954 | A1 | * | 11/2009 | De Paula et al. | 229/240 |

FOREIGN PATENT DOCUMENTS

| | | | |
|---|---|---|---|
| JP | 2000118525 | A | 4/2000 |
| JP | 2002145245 | A | 5/2002 |
| JP | 2006062686 | A | 3/2006 |
| JP | 2006193186 | A | 7/2006 |
| JP | 2006248554 | A | 9/2006 |
| JP | 2006273359 | A | 10/2006 |

* cited by examiner

COOLER CARTON

CROSS-REFERENCE TO RELATED APPLICATIONS

This application is a continuation of International Application No. PCT/US2008/000716, filed Jan. 18, 2008, entitled "Cooler Carton," which designates the United States of America and which claims the benefit under 35 U.S.C. §119 (e) of U.S. Provisional Application No. 60/881,286, filed Jan. 19, 2007.

BACKGROUND

Dispensing cartons for beverage cans and a wide variety of other items are known. Conventional dispensing cartons may have a panel or combination of panels formed with a dispensing feature through which items may be obtained by a user. Coolers for cooling beverages and other items also are known. Such coolers may include insulated bodies into which are placed items to be cooled along with ice to cool the items. A need exists for a dispensing carton that also can be used for cooling items contained therein as well as dispensing the items through a dispensing feature. It is to the provision of such a carton, a method of erecting the carton, and a blank from which the carton is erected that the present invention is primarily directed.

SUMMARY

The entire disclosures of International Application No. PCT/US2008/000716 and U.S. Provisional Application No. 60/881,286 are hereby incorporated by reference in their entirety as though fully set forth herein.

Briefly described, the present invention comprises a carton, a carton blank for from which the carton may be erected, and a method of erecting the carton from the carton blank. According to one embodiment, the carton blank comprises at least an outer top panel, a first side panel, a bottom panel, a second side panel, and an inner top panel, all generally rectangular in shape and foldably connected one to the next along creases. The blank further includes various end panels foldably connected to the ends of respective ones of the above panels and configured to be folded to form the closed ends of a carton erected from the blank. The end panels connected to the first and second side panels have oblique double creases formed therein that fold inwardly when the end panels are folded to close the ends of the carton to define gussets in the bottom corner portions of a fully erected carton. Tabs, separated by gaps, extend from the ends of the outer top panel and these tabs, when folded according to the method of the invention, form openable flaps on either end portion of the top of a fully erected carton. Each of the outer top panel and the inner top panel, which overlie one another in the erected carton, are formed with central perforation lines along their center portions and oblique perforation lines that extend from the ends of the central perforation lines to the corners of panels.

The carton is erected from the blank by folding and gluing the various panels and tabs as described in detail below to form an erected carton. At some point in the process, the carton may be filled with beverage cans (or another item or product) before it is completely closed. When it is desired to open the carton, the flaps on either end of the top panels are pulled up and back, which breaches the top of the carton along the oblique perforation lines. The outer and inner top panels are separated along their respective perforation lines and opened up. The result is an open carton revealing the beverage cans or other items therein, with a surrounding skirt that extends above the tops of the cans. Ice can be added on top of the beverage cans to cool the beverage therein and the ice is contained by the upwardly open surrounding skirt. Beverage cans are dispensed by searching through the ice and grasping a can when located under the ice.

As the ice melts, water collects in the bottom region of the container. The gussets, mentioned above, that are formed at the bottom corner portions in this region insure that the region is bounded by a continuous section of paperboard with no seams or glue lines through which the water can leak. This, in conjunction with a coating of water resistant material on the inside surfaces of the carton in one embodiment, insures that water from melted ice is contained within the bottom region of the container and does not readily leak out onto floors or other supporting surfaces.

Additional features, aspects, and details of the present invention will become more completely understood upon review of the detailed description and claims set forth below taken in conjunction with the various drawing figures, which are briefly described as follows.

DETAILED DESCRIPTION

The invention generally relates to cartons suitable for storing and dispensing articles such as, for example, beverage containers, and methods of erecting such cartons from a carton blank. Articles that may be contained by such cartons include, but are not limited to, petaloid bottle containers, beverage cans, glass or plastic bottles, or other containers such as those used in the packaging of juices and other foodstuffs. For purposes of illustration and not limitation, the detailed description below describes one embodiment of the invention within the context of a carton for beverage cans. However, any other appropriate containers or articles might be substituted for the beverage cans within the scope of the invention. Further, references herein to "end," "side," "bottom," and "top" refer to orientations or positions of elements when the carton is erected and disposed in an upright orientation. The terms "upper," "lower," "vertical," "horizontal," and "oblique" generally refer to the location and/or orientation of an element or line with respect to a drawing figure in which it appears.

Figure 1:
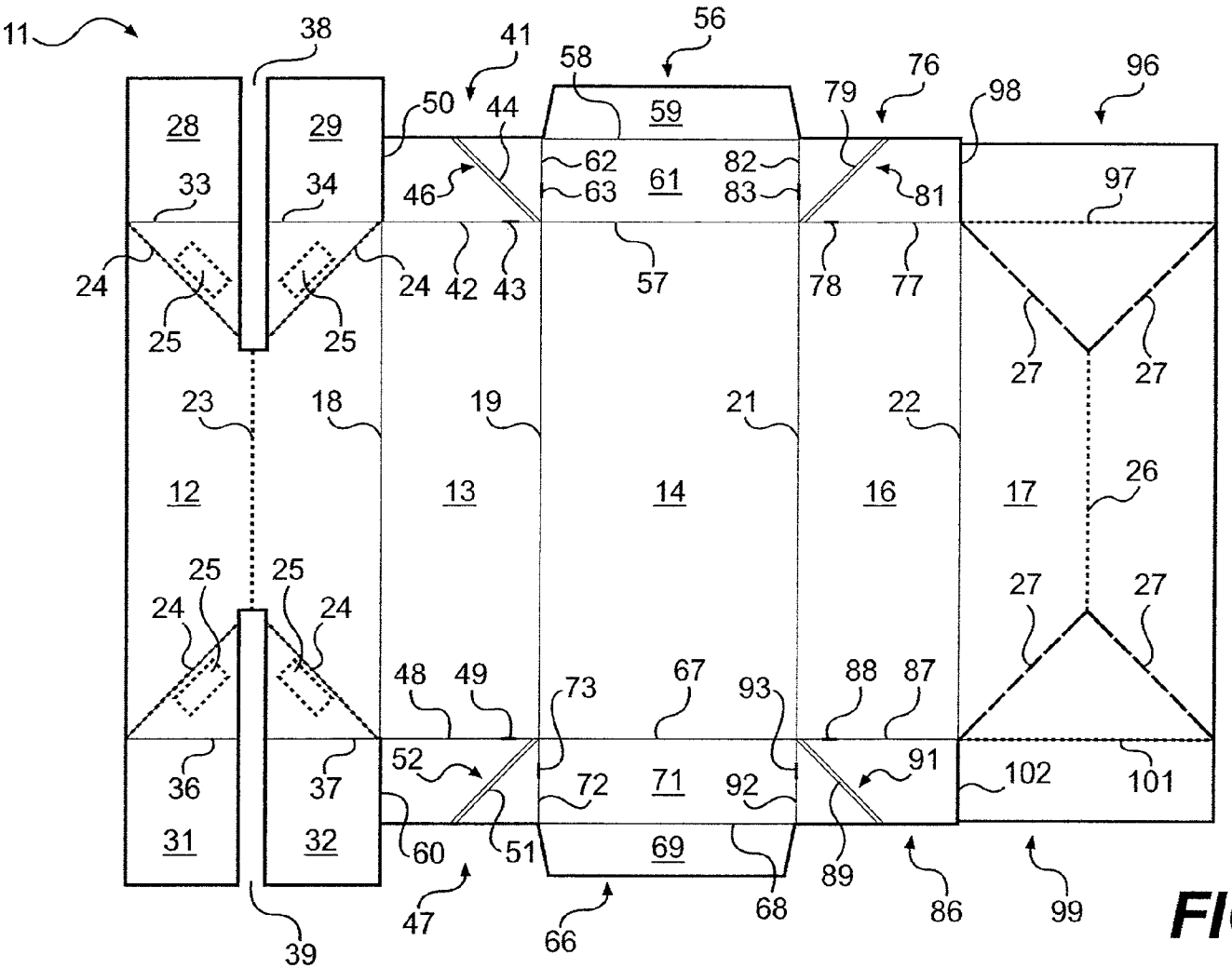
FIG. 1 is a plan view of a carton blank that embodies principles of the present invention in one form.

Referring now in more detail to the drawing figures, wherein like reference numerals indicate like parts throughout the several views, FIG. 1 illustrates a carton blank 11 from which a carton according to this invention (FIG. 20) may be erected. The blank 11 is shown with its outside or print side up. The blank 11 includes a outer top panel 12, a first side panel 13, a bottom panel 14, a second side panel 16, and an inner top panel 17. The outer top panel 12 is foldably connected to the first side panel 13 along vertical crease 18 and the first side panel 13 is foldably connected to the bottom panel 14 along vertical crease 19. Similarly, the bottom panel 14 is foldable connected to the second side panel 16 along vertical crease 21 and the second side panel 16 is foldably connected to the inner top panel along vertical crease 22.

A vertical perforation line 23 substantially bisects the central portion of the outer top panel 12 and oblique cut-creases 24 extend from near the ends of the perforation line 23 to the corners of the outer top panel 12. Similarly, a vertical perforation line 26 substantially bisects the central portion of the inner top panel 17, but for this panel, oblique perforation lines 27, rather than cut-creases, extend from the ends of perforation line 26 to the corners of inner top panel 17. Partial cutouts 25 are formed along the outboard side of oblique cut-creases 24 of panel 12 by partial cuts bounding a rectangular region. While the partial cutouts 25 are rectangular in the illustrated embodiment, they may be formed in other shapes if desired.

Upper tabs 28 and 29 are foldably connected to the outer top panel 12 along horizontal cut-creases 33 and 34 respectively and lower tabs 31 and 32 are foldably connected to the outer top panel 12 along horizontal cut-creases 36 and 37 respectively. The upper tabs 28 and 29 are separated by a vertical cut out gap 38, which extends into the outer top panel 12 to a position near the intersection of oblique cut-creases 24 and the upper end of perforation line 23. Similarly, the lower tabs 31 and 32 are separated by a vertical cut out gap 39, which extends into the outer top panel 12 to a position near the intersection of oblique cut-creases 24 and the lower end of perforation line 23. The perforation line 23 and the oblique cut-creases 24 are configured to be torn when the carton of this invention is opened up, as described in more detail below.

An upper end panel 41 is foldably connected to first side panel 13 along crease 42, which includes a partial cut 43 at one end portion. An oblique double score line 44 is formed in the upper end panel 41 and defines a gusset 46 on the right hand portion of first end panel 41 in FIG. 1. Upper end panel 41 is separated from tab 29 along cut line 50. A lower end panel 47, which is a mirror image of upper end panel 41, is foldably connected to first side panel 13 along crease 48, which includes a partial cut 49 at one end. An oblique double score line 51 is formed in the lower end panel 47 and defines a gusset 52 on the right hand portion of the second end panel 47 in FIG. 1. Lower end panel 47 is separated from tab 23 along cut line 60. The gussets 46 and 52 are configured to fold inwardly to form a water resistant bottom corner portion of a carton when the blank is erected, as detailed more fully below.

Upper end panel 56 is foldably connected to bottom panel 14 along crease 57 and is divided by crease 58 into an upper section 59 and a lower section 61. The lower section 61 of upper end panel 56 is foldably connected to upper end panel 41 along crease 62, which includes a partial cut 61 along part of its length. Lower end panel 66 is foldably connected to bottom panel 14 along crease 67 and is divided by a crease 68 into a lower section 69 and an upper section 71. The upper section 71 of lower end panel 66 is foldably connected to lower end panel 47 along crease 72, which includes a partial cut 73 along part of its length.

Upper end panel 76 is foldably connected to second side panel 16 along crease 77, which includes a partial cut 78 along part of its length. An oblique double score line 79 is formed in the upper end panel 76 and defines a gusset 81 on the left hand portion of the upper end panel 76. The upper end panel 76 is foldably connected to the lower section 61 of end panel 56 along crease 82, which includes a partial cut 83 along part of its length. Lower end panel 86 is foldably connected to second side panel 16 along crease 87, which includes a partial cut 88 along part of its length. An oblique double score line is formed in the lower end panel 86 and defines a gusset 91 on the left hand portion of the lower end panel 86 in FIG. 1. The lower end panel 86 is foldably connected to the upper section 71 of end panel 66 along crease 92, which includes a partial cut 93 along part of its length. Like gussets 46 and 52, gussets 81 and 91 are configured to fold inwardly when the blank is erected to form a water resistant bottom corner portion when the carton of this invention is erected.

Upper end panel 96 is foldably connected to inner top panel 17 along cut-crease 97 and is separated from upper end panel 76 along cut line 98. Similarly, lower end panel 99 is foldably connected to inner top panel 17 along cut-crease 101 and is separated from lower end panel 86 along cut line 102.

Figure 2:
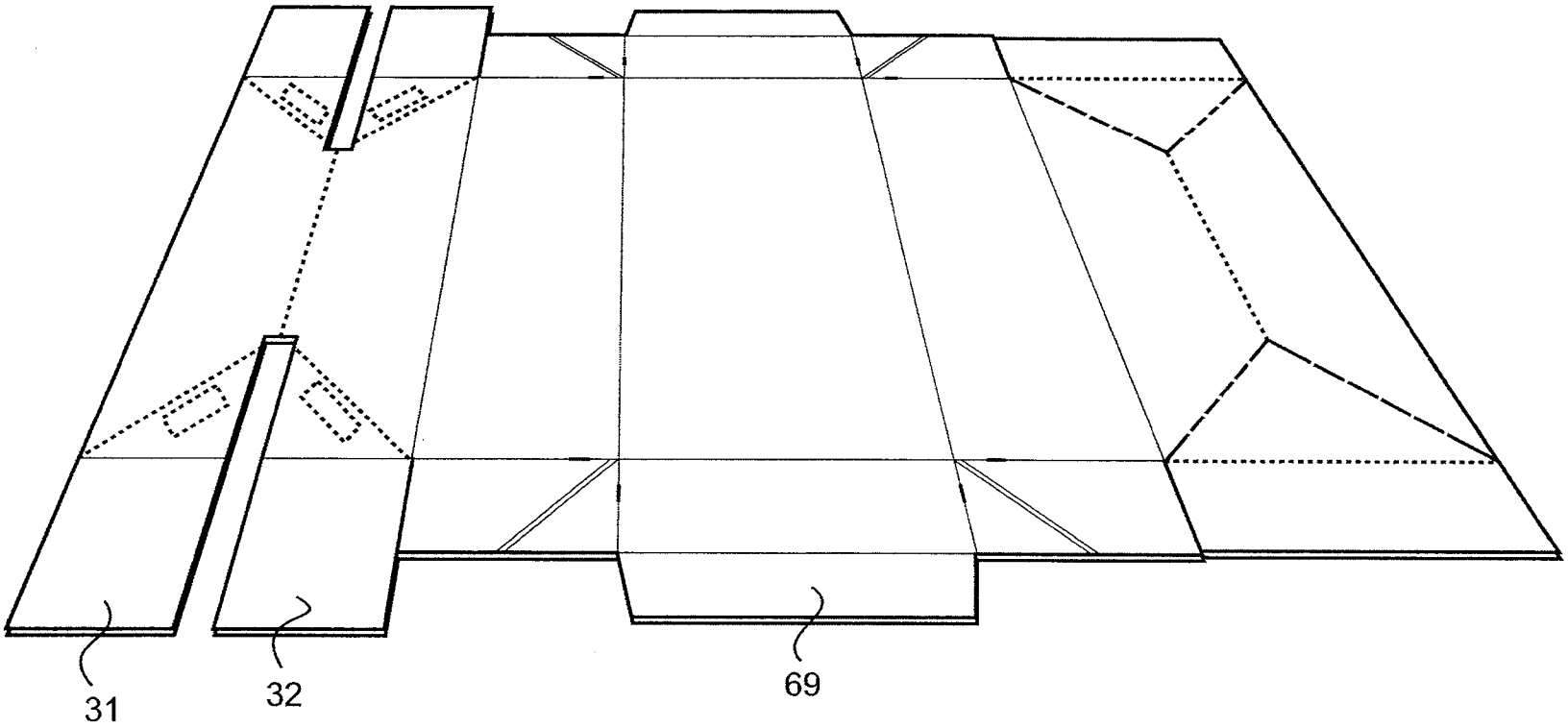
FIG. 2 shows the carton blank of FIG. 1 with its top or print side facing upwardly.
Figure 3:
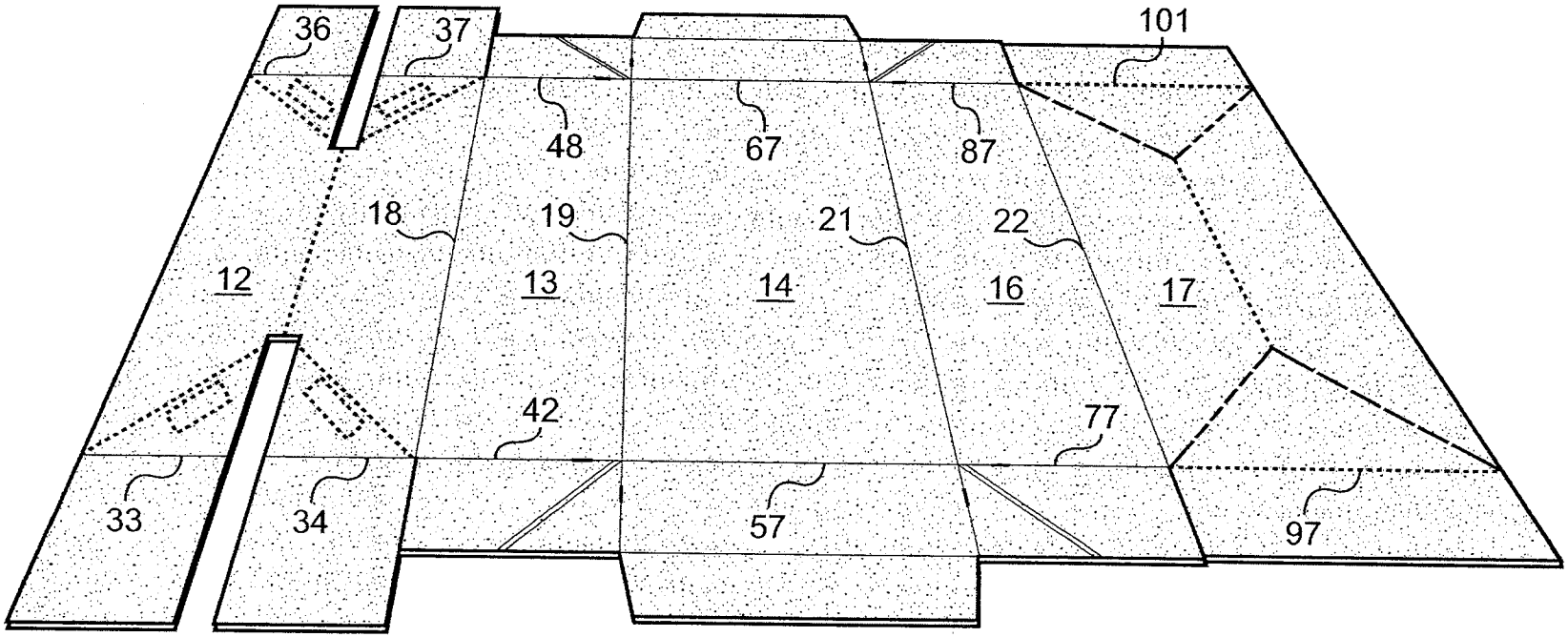
FIG. 3 shows the carton blank of FIG. 1 with its top or print side facing downwardly.

With the carton blank of the invention described in detail, an exemplary method of erecting the blank 11 into the carton of the invention will now be described with reference to FIGS. 2-20. FIG. 2 simply illustrates the carton blank shown in FIG. 1 with its exterior or print side up. This figure is essentially the same as FIG. 1 and thus need not be described in detail. FIG. 3 illustrates the carton blank 11 flipped over with its interior or second side up. For clarity of description, the interior side of the carton blank is lightly stippled throughout the figures to distinguish it from the exterior or print side of the blank. Some of the major elements of the blank 11 are identified with their reference numbers in FIG. 3 for purposes of orientation, including panels 12, 13, 14, 16, and 17 as well as creases 34, 35, 36, 37, 42, 48, 57, 67, 77, and 87 and cut-creases 97 and 101. It will be appreciated that the preferred embodiment of the blank 11 is symmetric about a horizontal center line in FIG. 1 so that the configuration of the interior side of the blank shown in FIG. 3 is the same as that of the exterior side of FIGS. 1 and 2, with reference numerals flipped top-to-bottom and bottom-to-top respectively. The erection sequence described below begins with the carton blank 11 as shown in FIG. 3.

Figure 4:
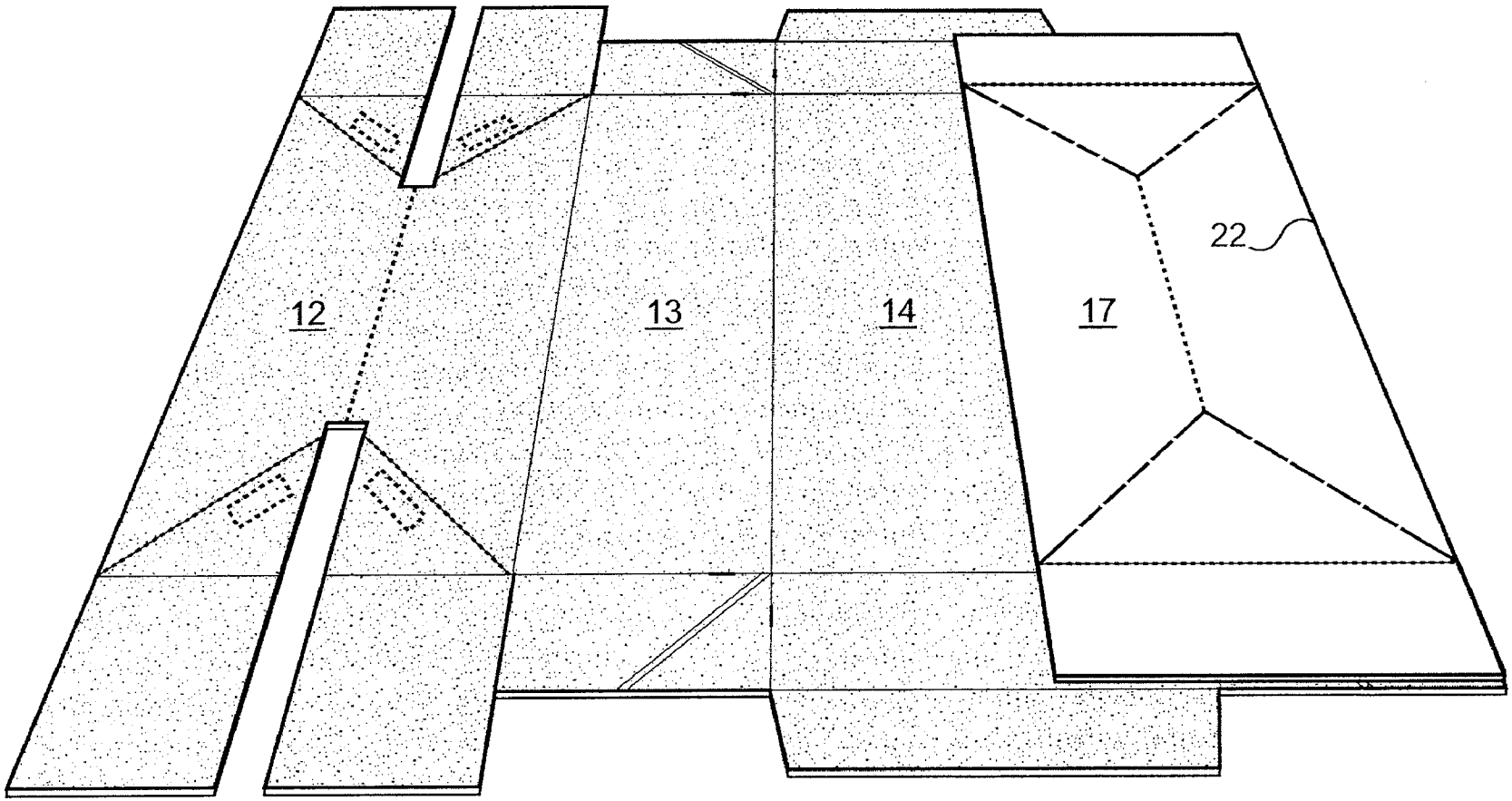
FIGS. 4-20 illustrate, in one form, the series of steps carried out in erecting the carton of the invention from the blank of FIGS. 1-3.
Figure 5:
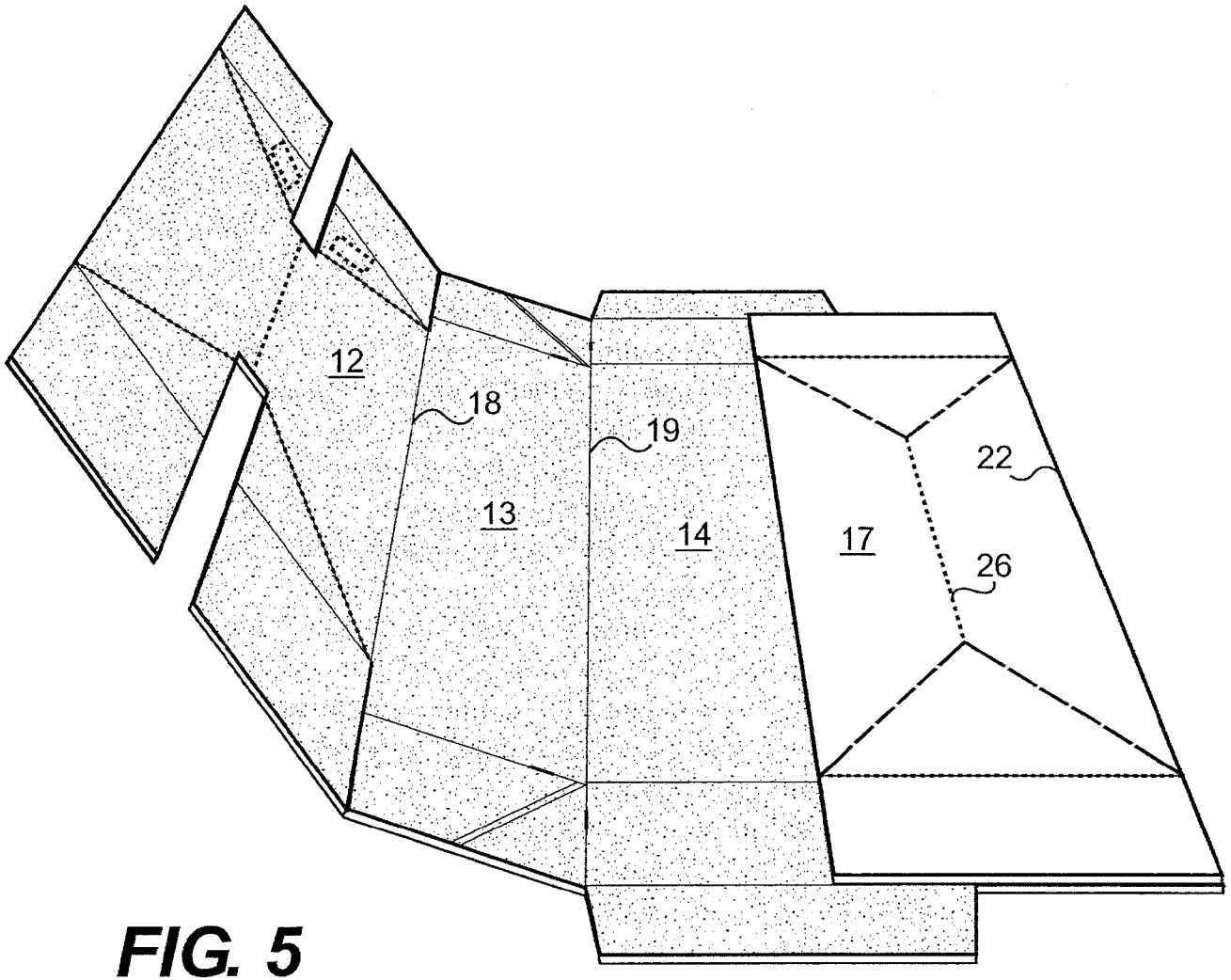
Figure 6:
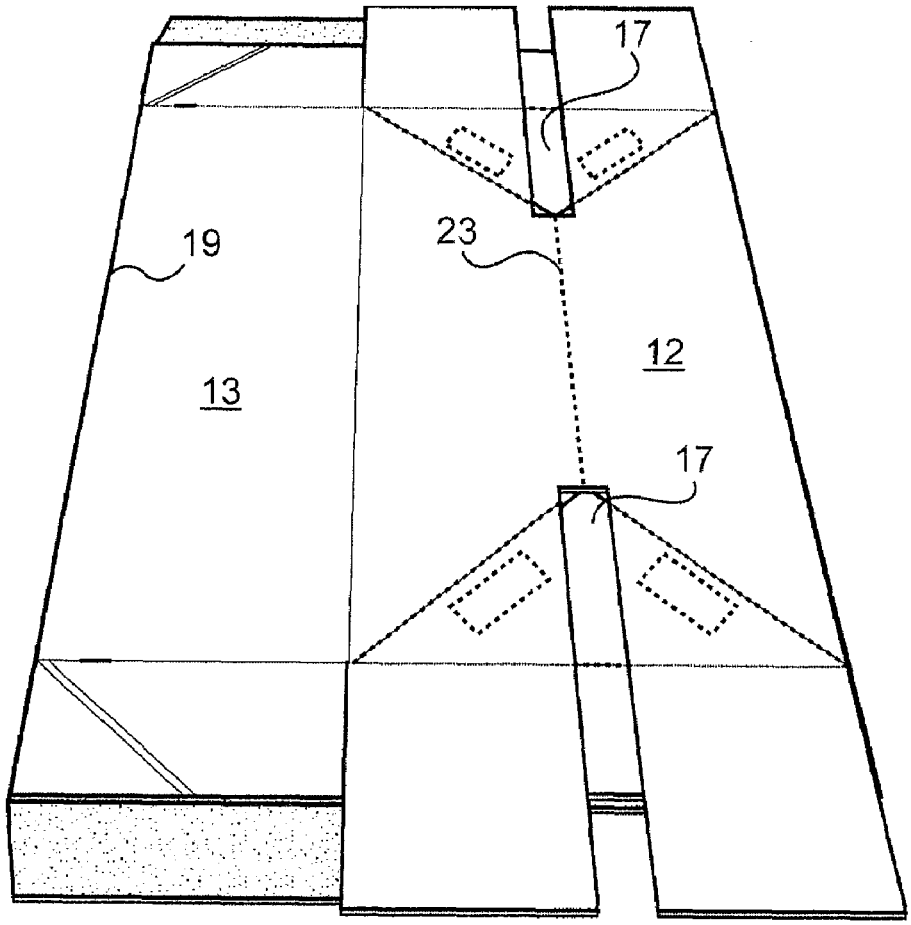

To erect the carton of this invention from the carton blank 11, the blank is folded along crease 22 as shown in FIG. 4 so that inner top panel 17 overlies second side panel 16 (not visible in FIG. 4) and partially overlies bottom panel 14. The blank is then folded along crease 19 (FIG. 5) until the outer top panel 12 overlies and substantially aligns with inner top panel 17 (FIG. 6). Glue or other appropriate adhesive is applied between the inner and outer top panels 12 and 17 so that these two panels become securely affixed to one another when folded into the configuration shown in FIG. 6. It has been found advantageous to apply the glue in strips or beads that extend along and on either side of the perforation line 26 for substantially the full length of the panel 17 in order to obtain a secure reliable bond between the outer top panel 12 and the inner top panel 17.

Figure 7:
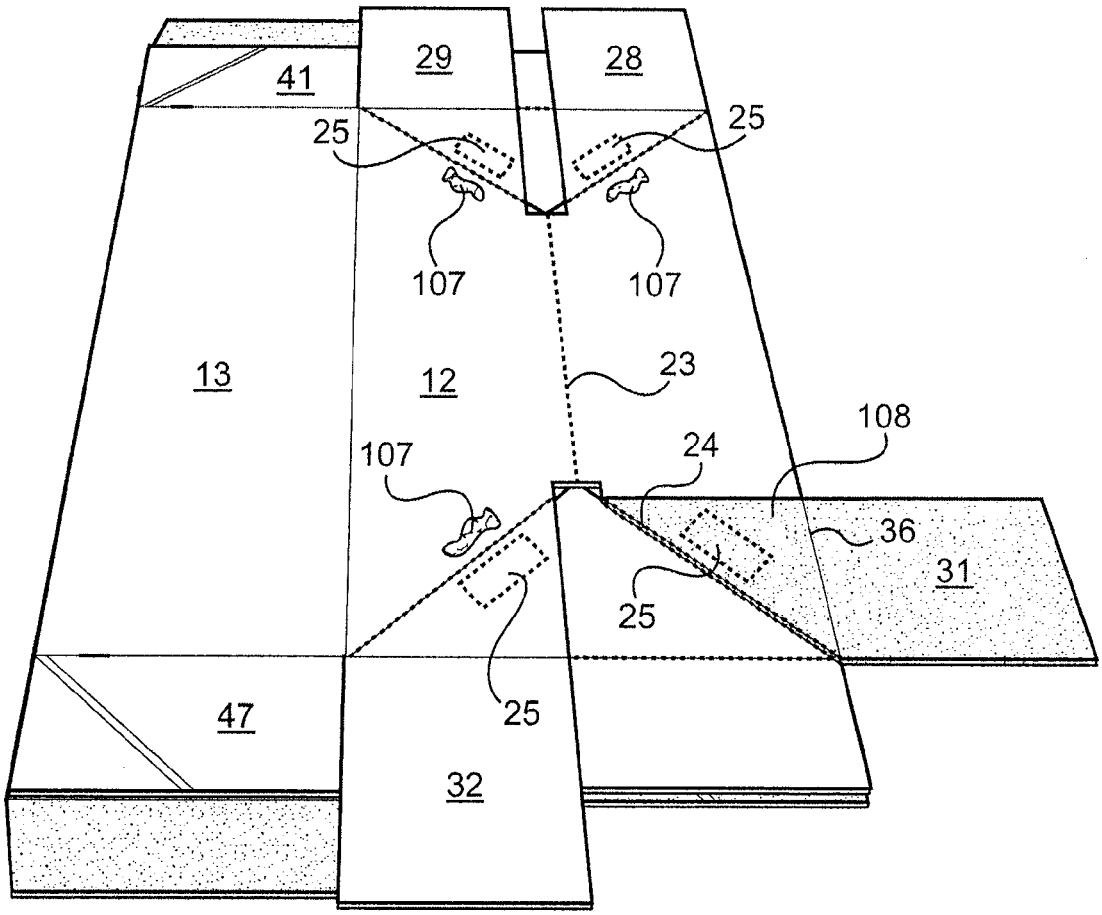
Figure 8:
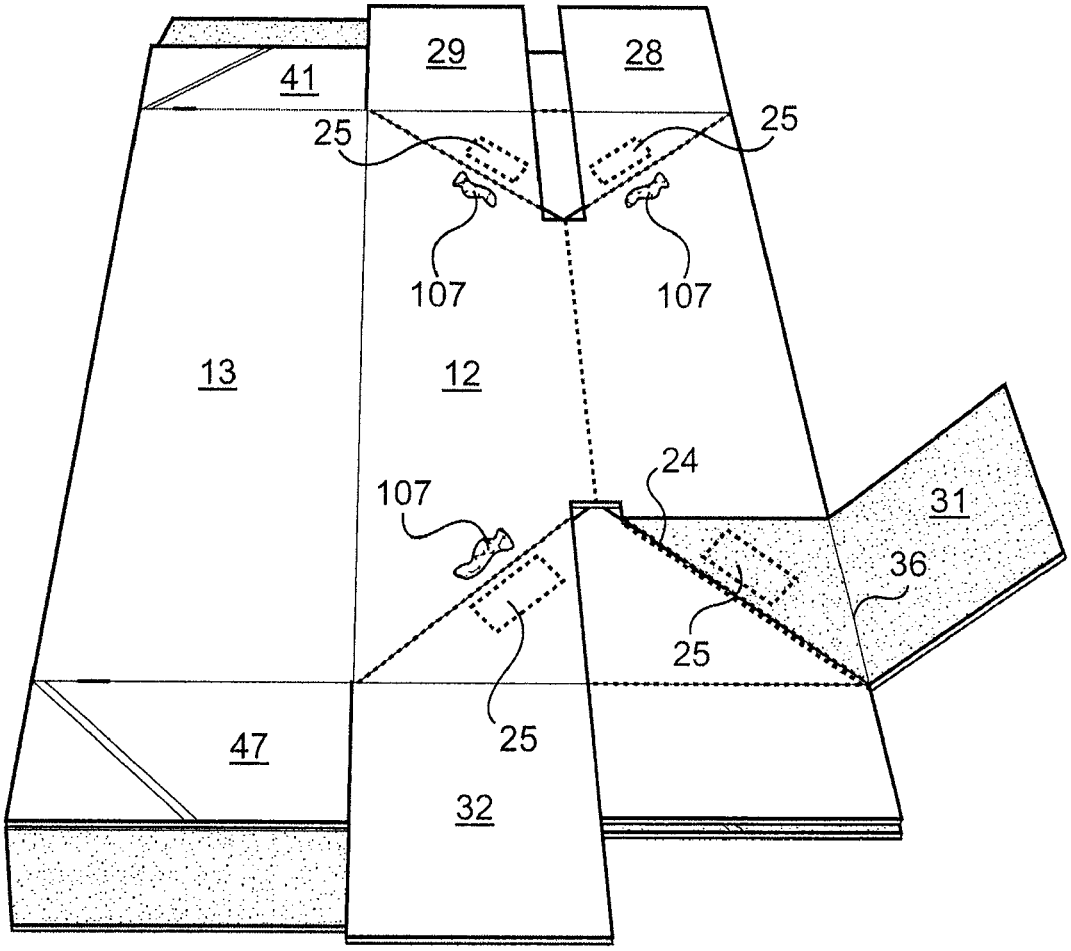
Figure 9:
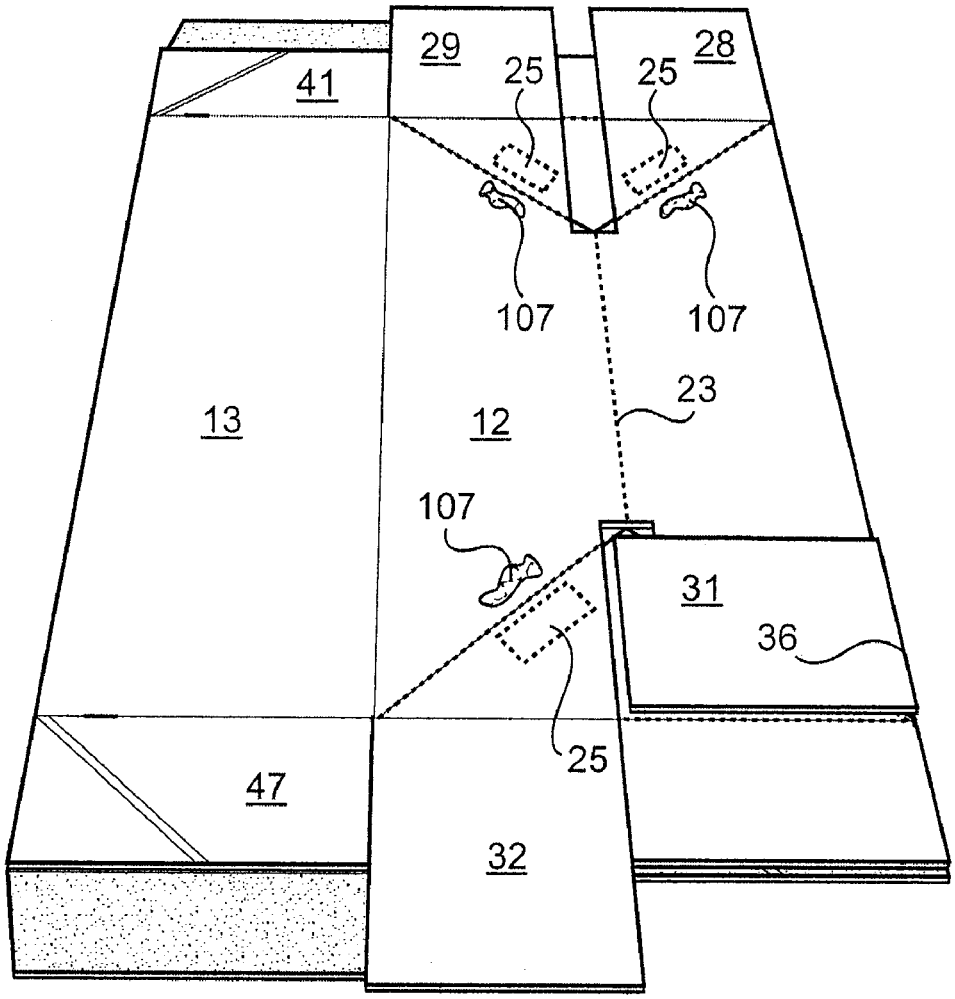
Figure 10:
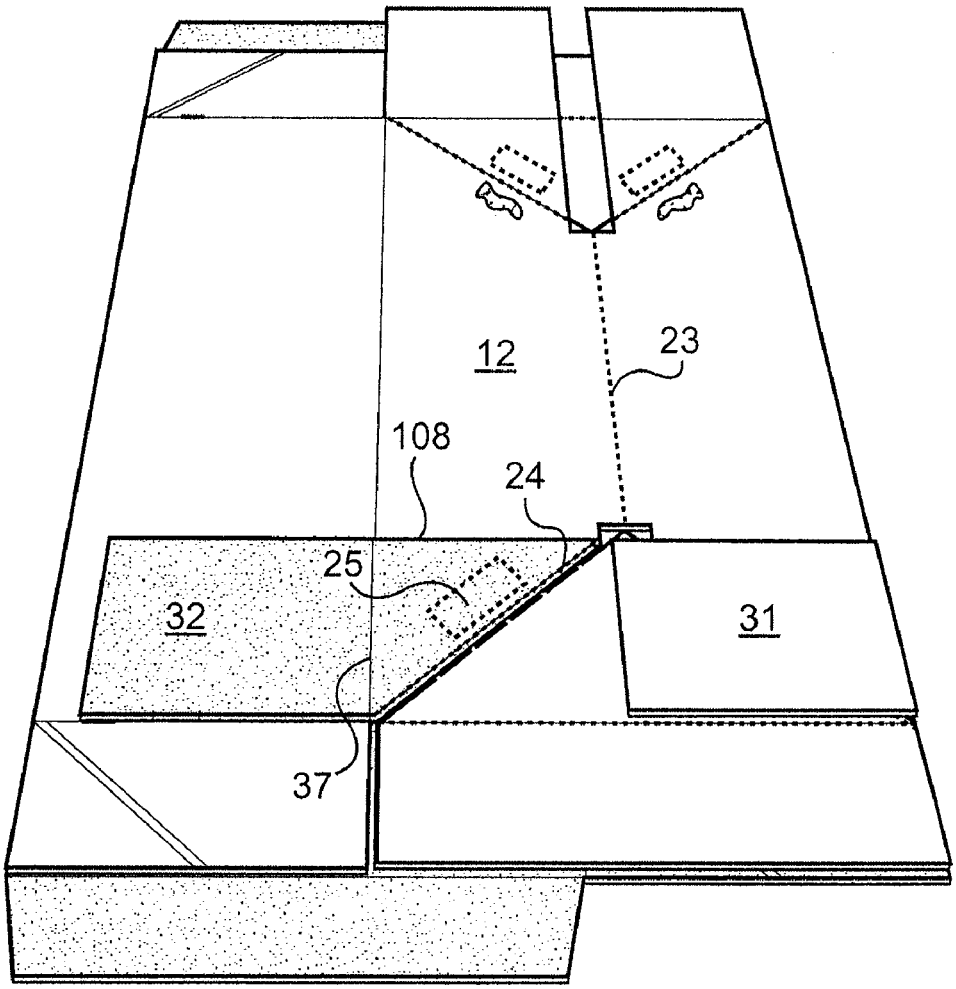
Figure 11:
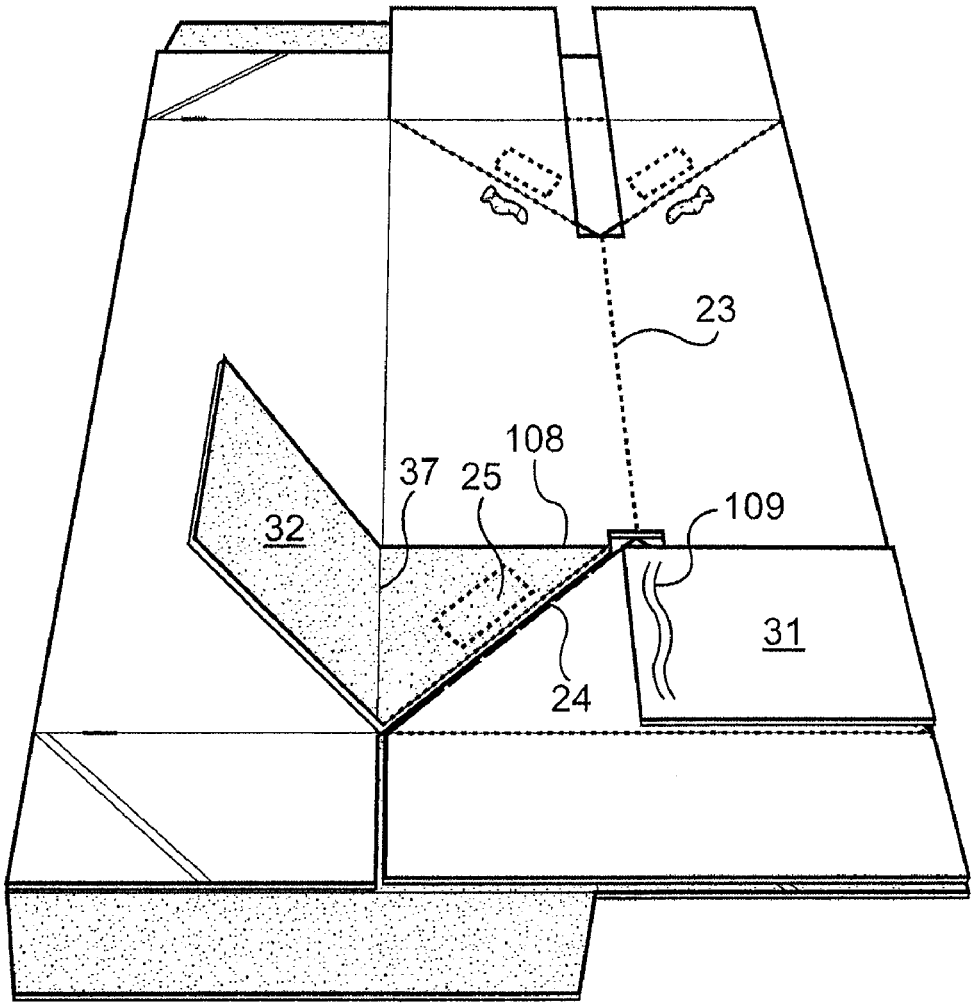
Figure 12:
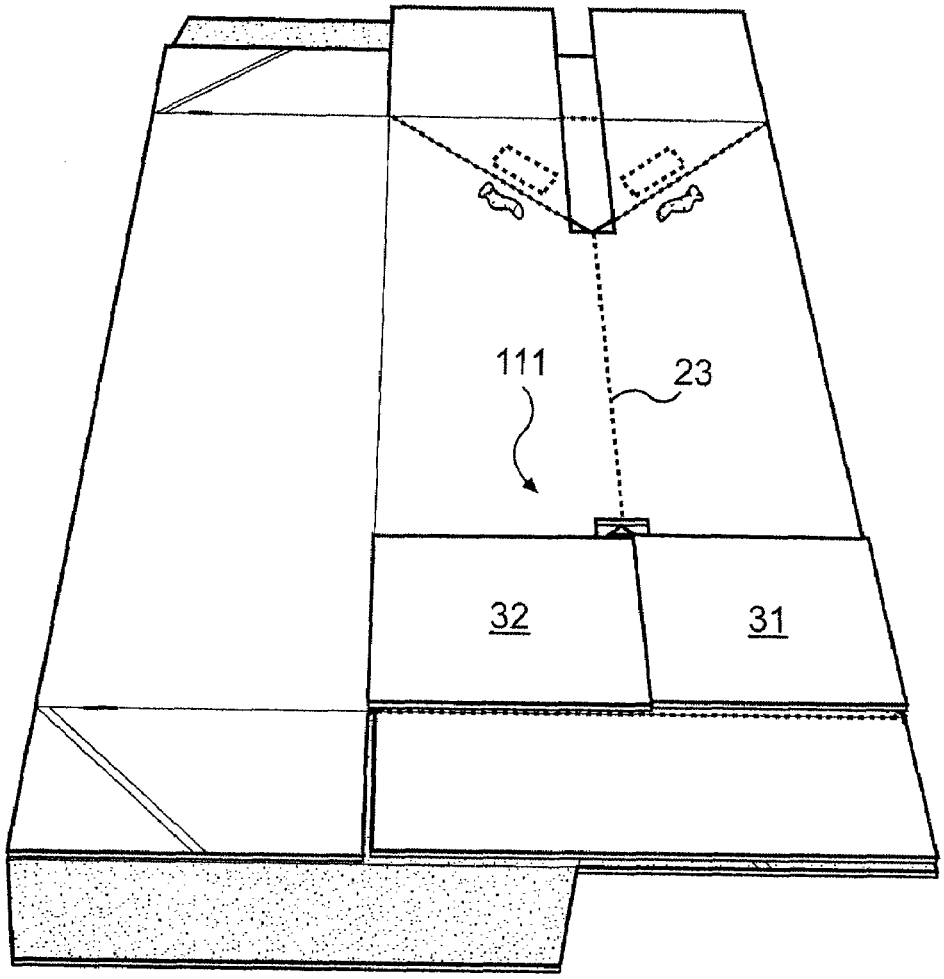
Figure 13:
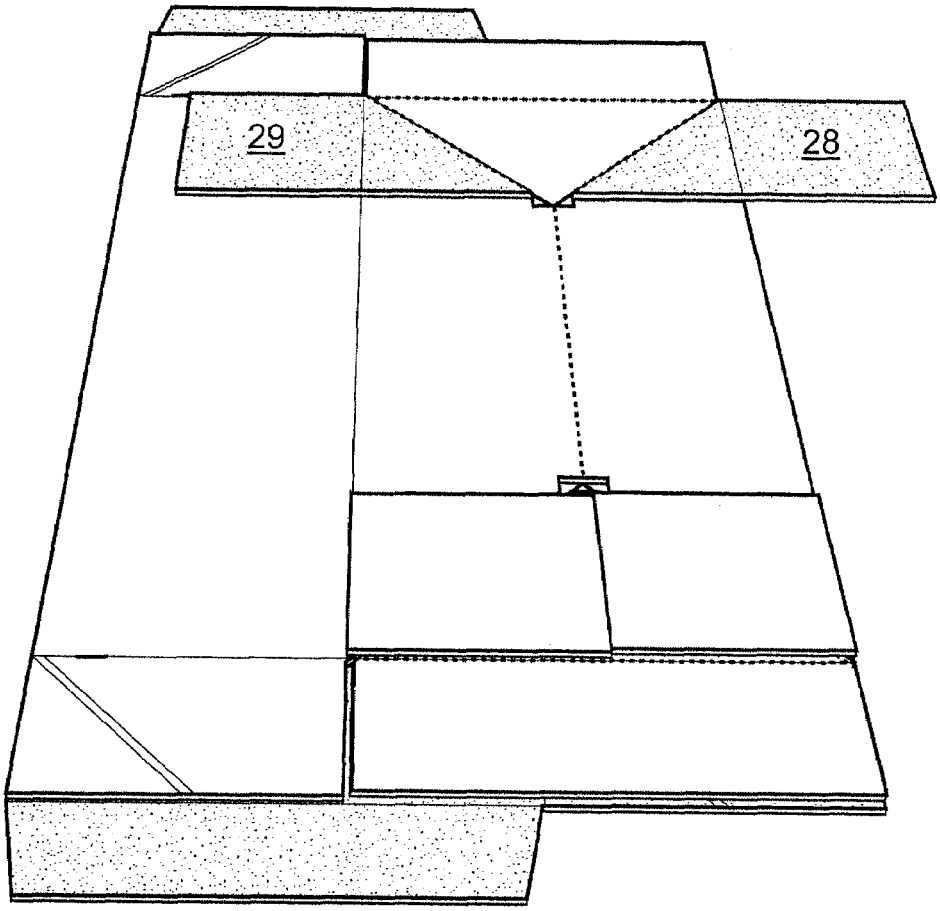

Referring to FIGS. 7-9, glue 107 is dispensed on the outer top panel 12 on the inboard sides of oblique cut-creases 24 opposite the partial cutouts 25. The glue is dispensed in a size and shape to insure that when the blank is folded along oblique cut-creases 24, the glue will engage the folded portion only within the partial cutouts. The blank is folded along one of the oblique cut-creases 24 so that the tab 31 extends out laterally relative to perforation line 23 (FIG. 7) and the resulting triangular section 108 overlies the surface of panel 12. When thus folded, the glue 107 bonds the triangular section 108 to the panel 12, but only within the area of the partial cutout 25. A back fold is then made along cut-crease 36 (FIG. 8) and the fold in continued until the tab 31 overlies the outer and inner top panels 12 and 17 respectively and overlies the triangular portion 108 created in the previous fold (FIG. 9). Referring to FIGS. 10-12, the blank 11 is folded along the adjacent oblique cut-crease 24 until the adjacent tab 32 extends out laterally relative to the perforation line 23 and the resulting triangular section 108 overlies the surface of panel 12. When thus folded, the glue bonds the triangular section 108 to the panel 12, but only within the area of the partial cutout 25. A back fold is made along cut-crease 37 (FIG. 11) and glue 109 is applied to the distal edge of adjacent tab 31. The back fold is continued until the tab 32 overlies the outer and inner top panels 12 and 17 respectively, overlies the triangular section 108, and the distal edge of the tab 32 overlies the distal edge of the tab 31 (FIG. 12), whereupon the glue 109 securely bonds the distal edges of the tabs 31 and 32 together to form a unitary flap 111.

Figure 14:
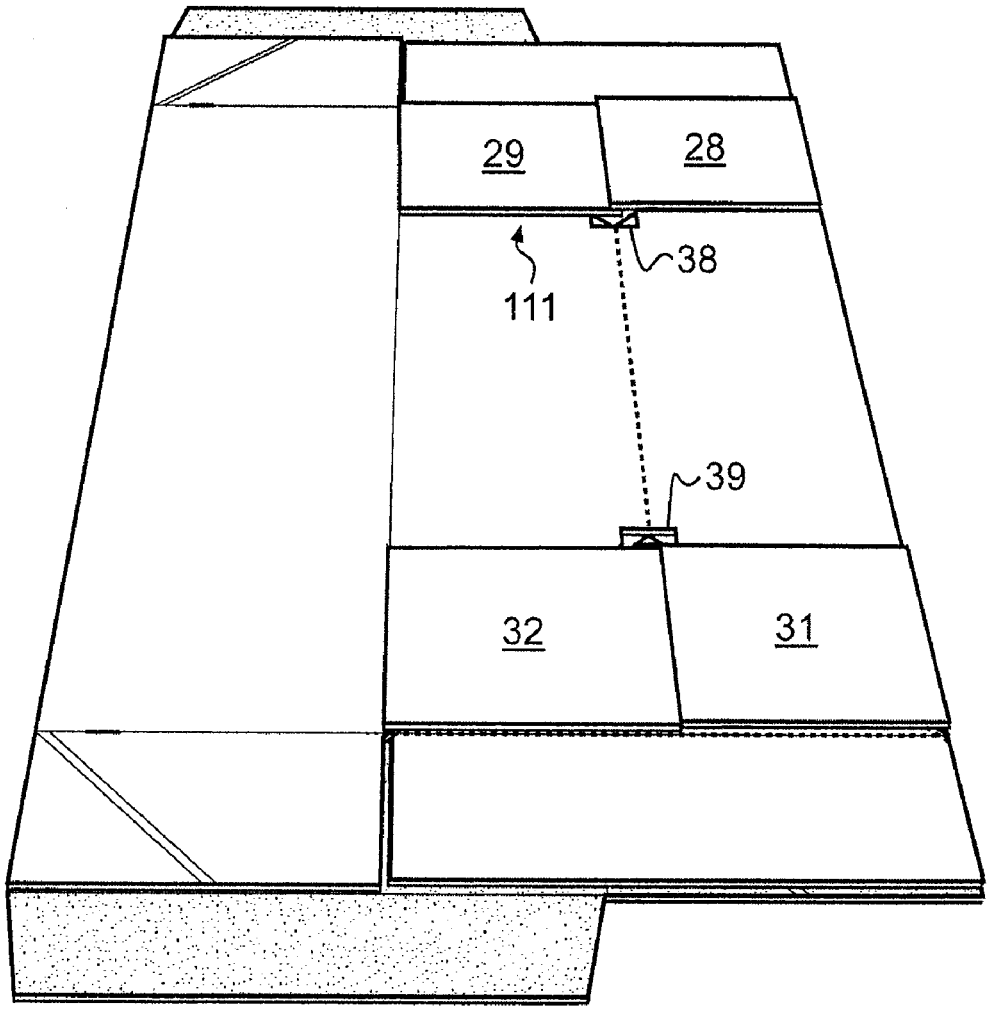

The just described process is carried out in the same way with tabs 28 and 29 (FIG. 13) until these tabs also form a unitary flap 111 on the opposite end of outer top panel 12 (FIG. 14). It will be noted that, when the flaps are completed, a short section on the end of gaps 38 and 39 protrudes slightly from underneath and beyond the edges of the flaps 111. Further, as perhaps most apparent in FIG. 12, the junctions of the vertical perforation line 26 and the oblique cut-creases 27 on the inner top panel 17 (see FIG. 1) are exposed beneath the protruding short sections of the gaps 38 and 39. This configuration facilitates the opening of the fully erected carton by a user as described in more detail below.

Figure 15:
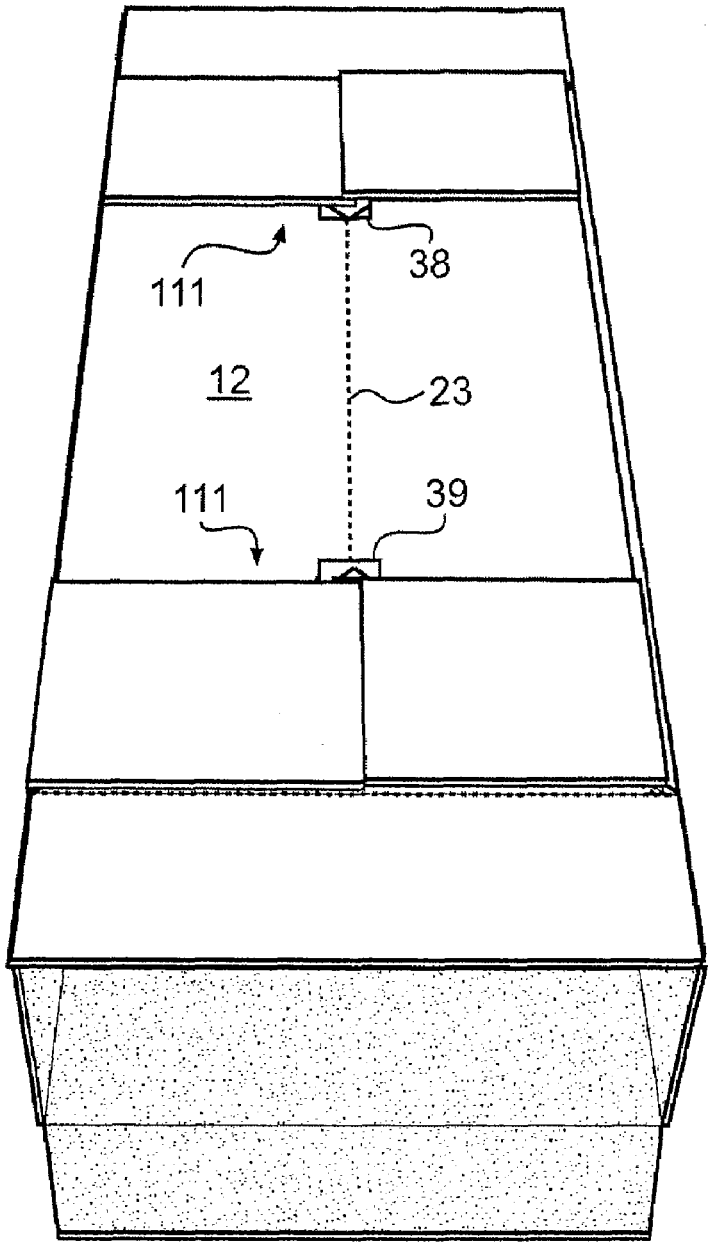
Figure 16:
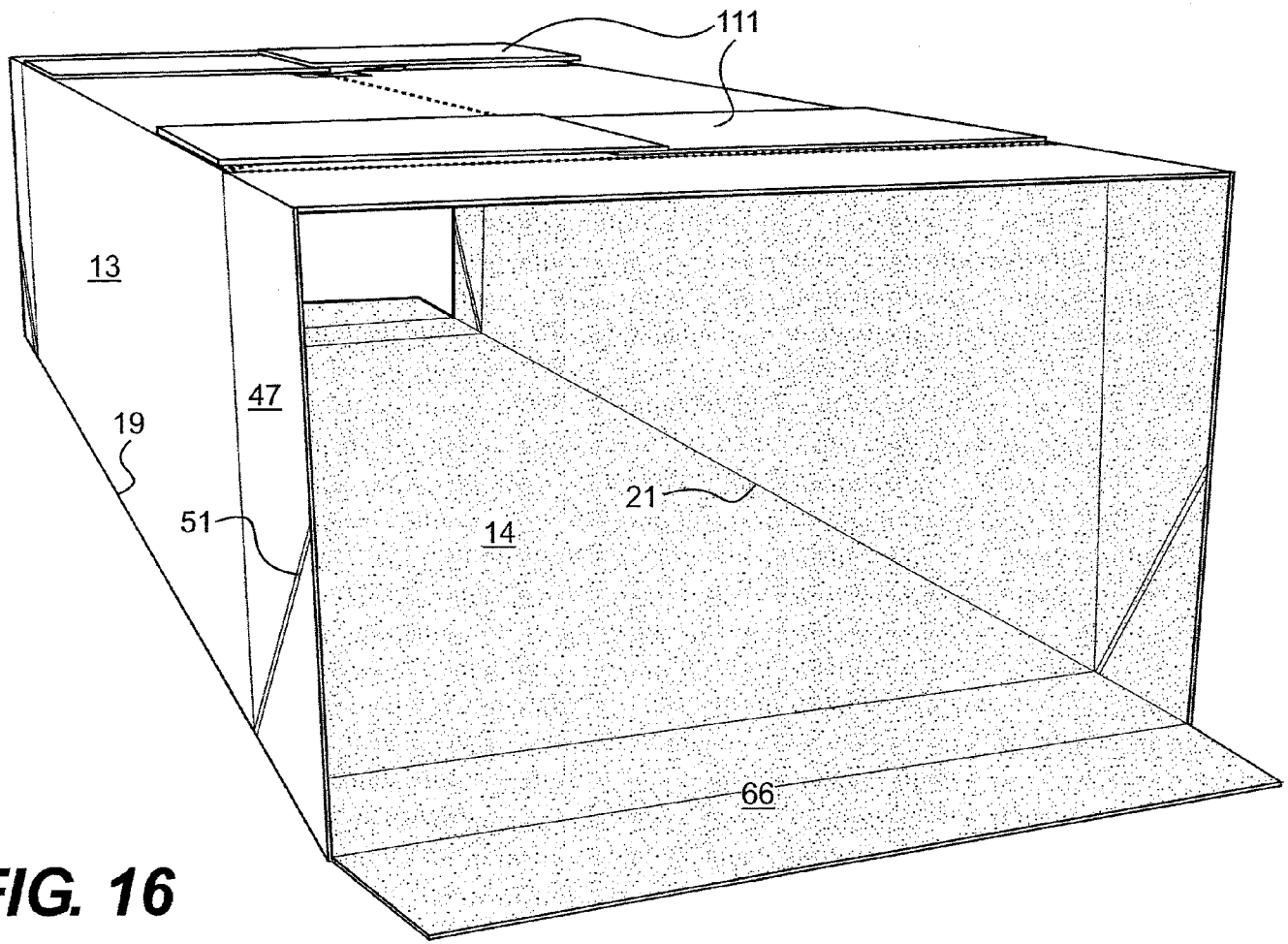

As illustrated in FIGS. 15 and 16, the carton is next opened up by folding the blank upwardly along creases 19 and 21 in a rather pantograph fashion until the carton forms a tube-like configuration with open ends (FIG. 16). In this configuration, the carton sits upright on bottom panel 14 with the outer and inner top panels 12 and 17 and the just described unitary flaps 111 defining the top of the carton.

Figure 17:
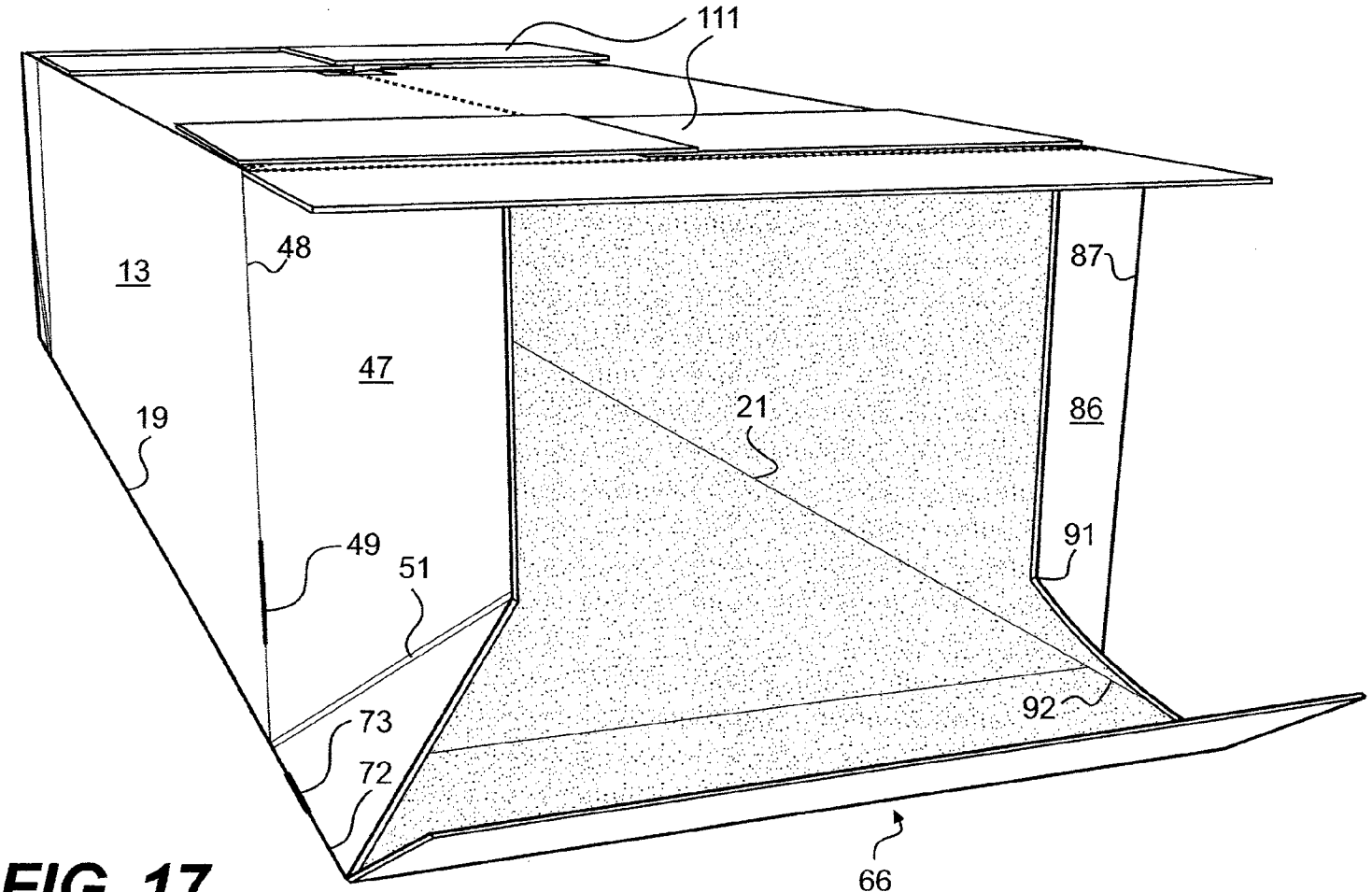
Figure 18:
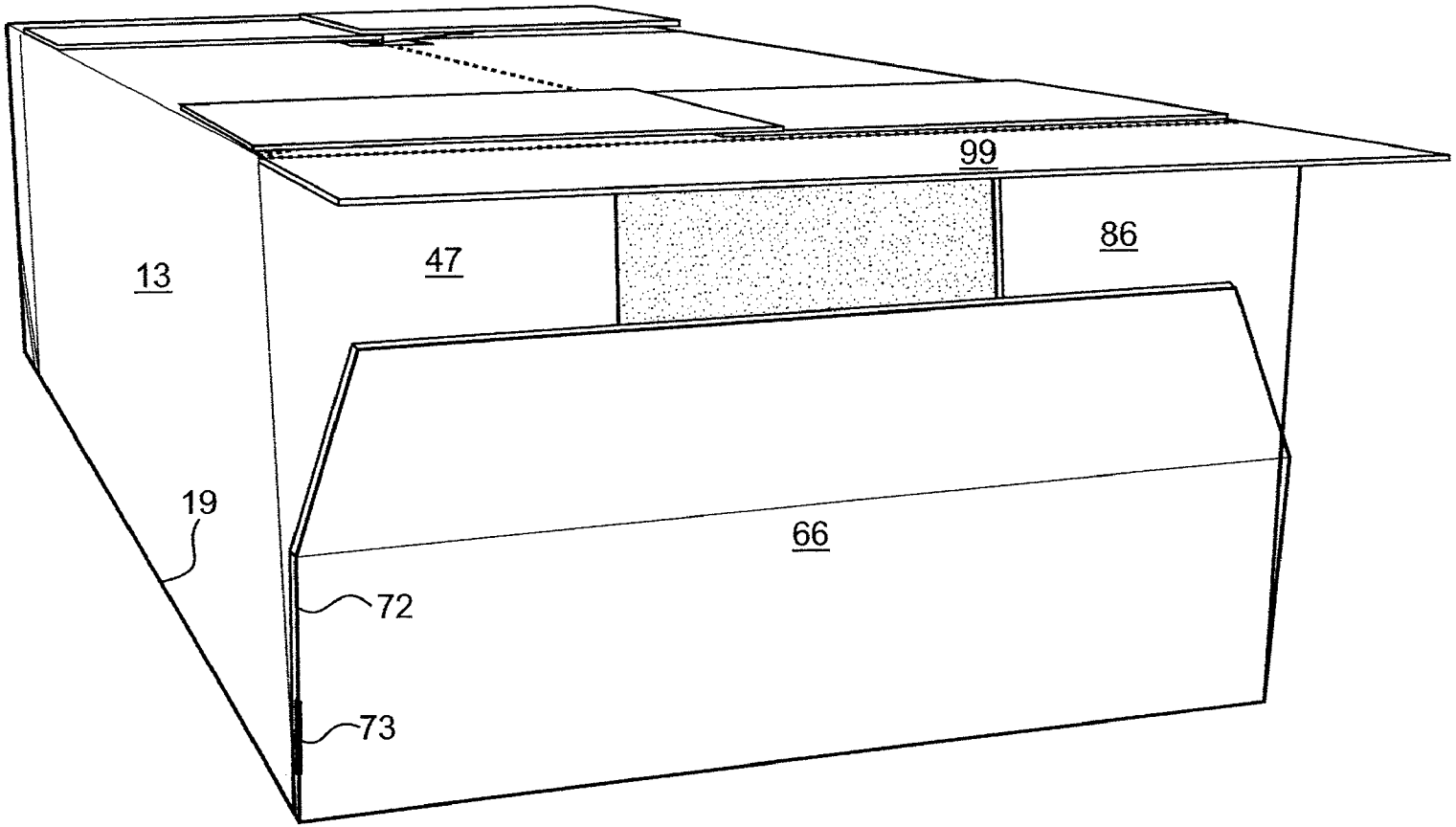
Figure 19:
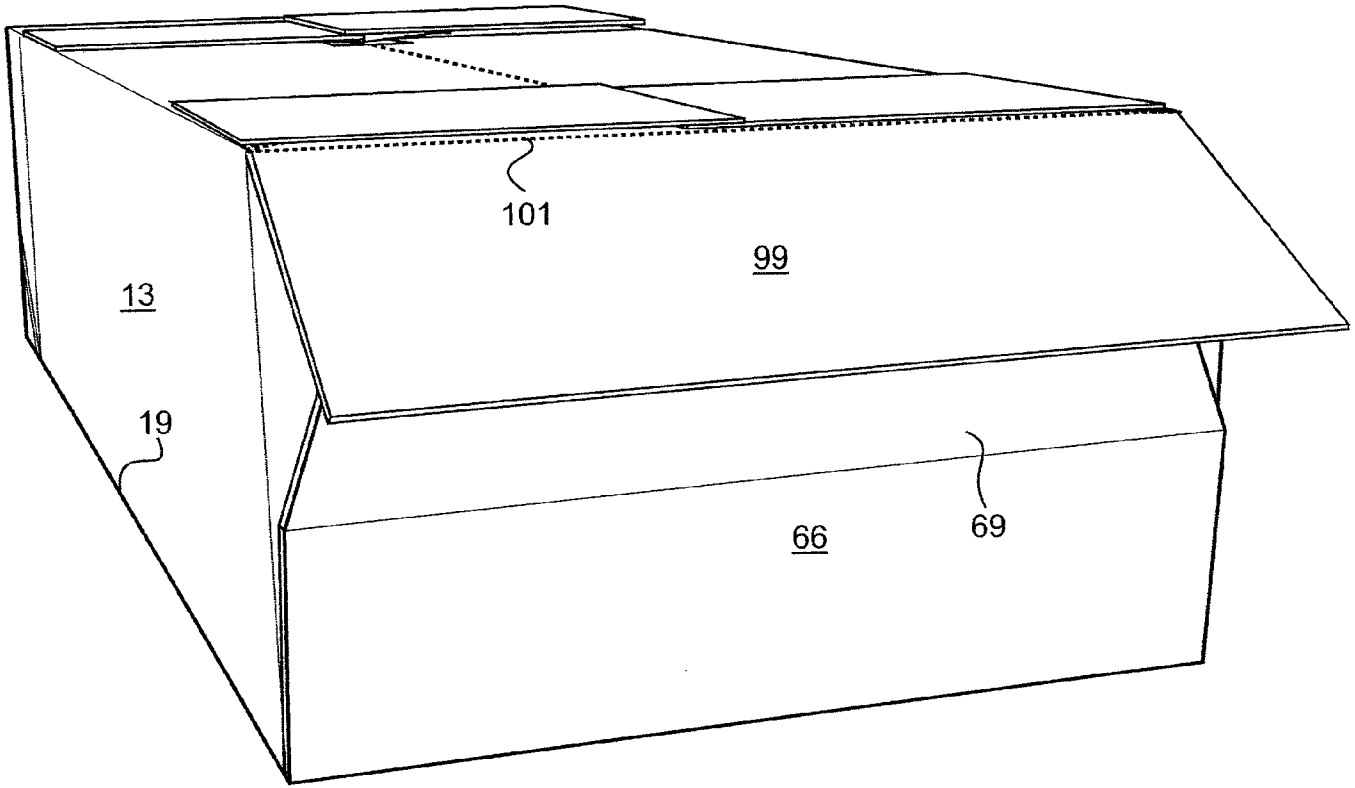

FIGS. 17-20 illustrate one folding sequence that forms the ends of the carton of this invention. Folding of the end panel 66 upwardly along crease 67 is begun as shown in FIG. 17. As the end panel 66 begins to fold upwardly, end panels 47 and 86 begin to fold inwardly along creases 48 and 87 respectively because of their connection to end panel 56 along creases 72 and 92. At the same time, the end panels 47 and 86 begin to fold onto themselves along respective double score lines 51 and 91. The folding upwardly of the end panel 66 and inwardly of end panels 47 and 86 is continued until the end panel 66 at least partially overlies the end panels 47 and 86, as best illustrated in FIG. 18. Glue can be applied to secure the end panel 66 to the end panels 47 and 86 if desired. In this configuration, the end panels 47 and 86 are completely folded over onto themselves along double score lines 51 and 91 to form gussets in the lower corner portions of the carton. These gussets are configured to provide a continuous layer of paperboard with no breaks or glue seams, which, in turn, forms a carton that, when properly treated, is capable of containing a certain amount of water or other liquid in at least its lower region without leaking.

Figure 20:
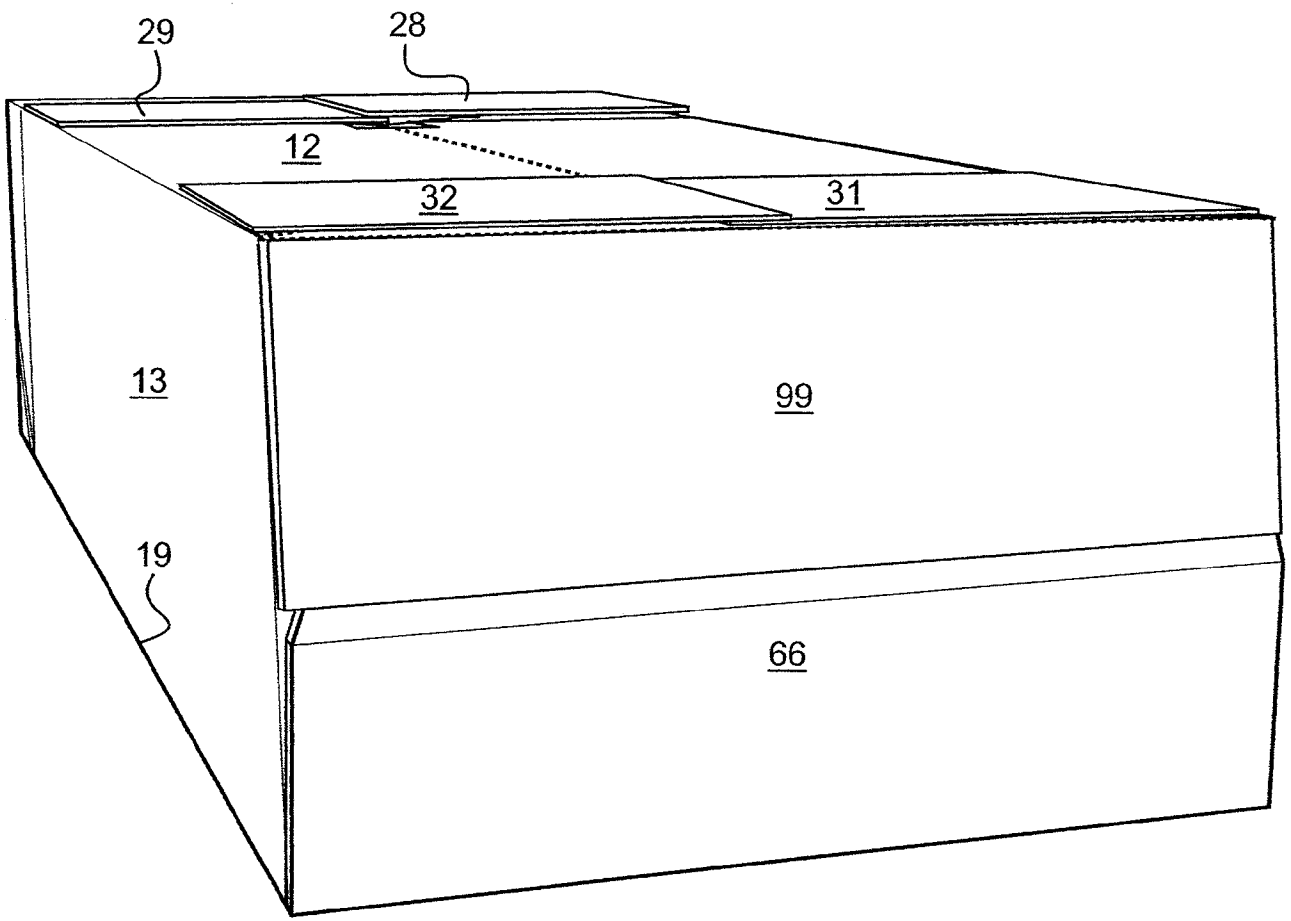

With the end panel 66 folded up (FIG. 18), the end panel 99 can then be folded down along cut-crease 101 (FIG. 19) until it overlies and is secured with glue to the upper section 69 of end panel 66 to close off the carton on one end with the other end still open. Alternately, end panel 99 can be folded down behind end panel 66 before panel 66 is completely folded, in which case end panel 66, and particularly the upper portion 69 of end panel 66, will overlie and be glued to the underlying end panel 99 to close of one end of the carton. In this configuration (one end closed and the other open), containers such a beverage cans can be packed into the carton from the open end, whereupon the same folding and gluing procedure just described is carried out at the open end of the carton to close off the other end of and complete the erection of the carton. Those of skill In the art will understand that while packing containers in a carton from an open end is one method of filling the carton with product, other methods are also known and may be applied with the present invention. For example, it is known to erect a carton around a grouping of containers and the carton of the present invention is adaptable to this and other alternative loading methods. Regardless of the loading method employed, FIG. 20 illustrates the fully erected carton of the invention, which, in the preferred embodiment, contains beverage cans for shipment to consumers.

Figure 21:
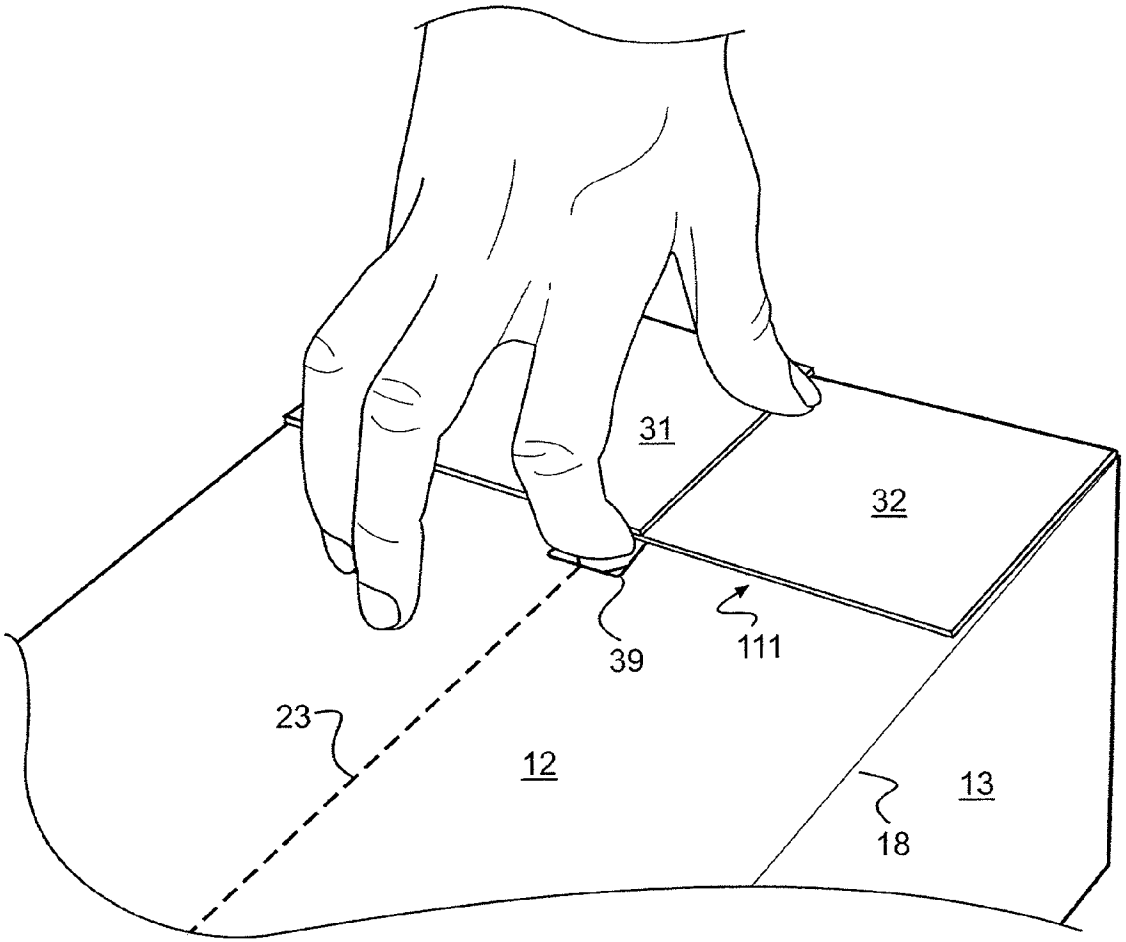
FIGS. 21-26 illustrate, in one form, the series of steps carried out in opening the erected carton for adding ice and/or dispensing the contents of the carton.

FIGS. 21-26 illustrate one method, most likely employed by an end user, of opening up the container of the present invention to add ice if desired for cooling the contents and for dispensing the contents of the carton. FIG. 21 shows the carton right side up with its outer top panel 12 bearing perforation line 23 and being connected along crease 18 to first side panel 13. Shown on one end of the carton is flap 111, which is formed of tabs 31 and 32 adhered together along their overlapping ends as described above. To open the carton a user first inserts a finger into the short portion of the gap 39 that protrudes slightly beyond the edge of the flap 111. The tip of the finger is then urged downwardly to breach the intersection of perforation line 26 and oblique cut-creases 27 of the underlying inner top panel 17, which intersection is located just under the protruding portion of gap 39. This step of the opening process is illustrated in FIG. 21.

Figure 22:
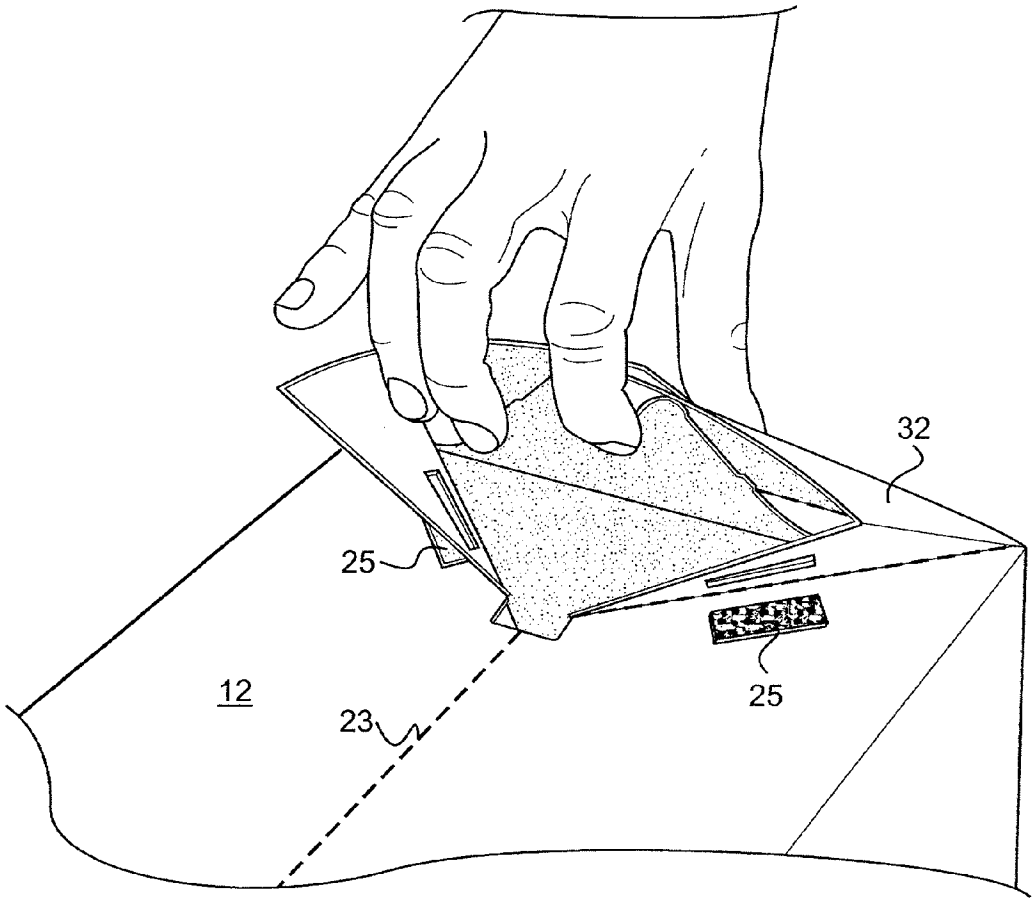
Figure 23:
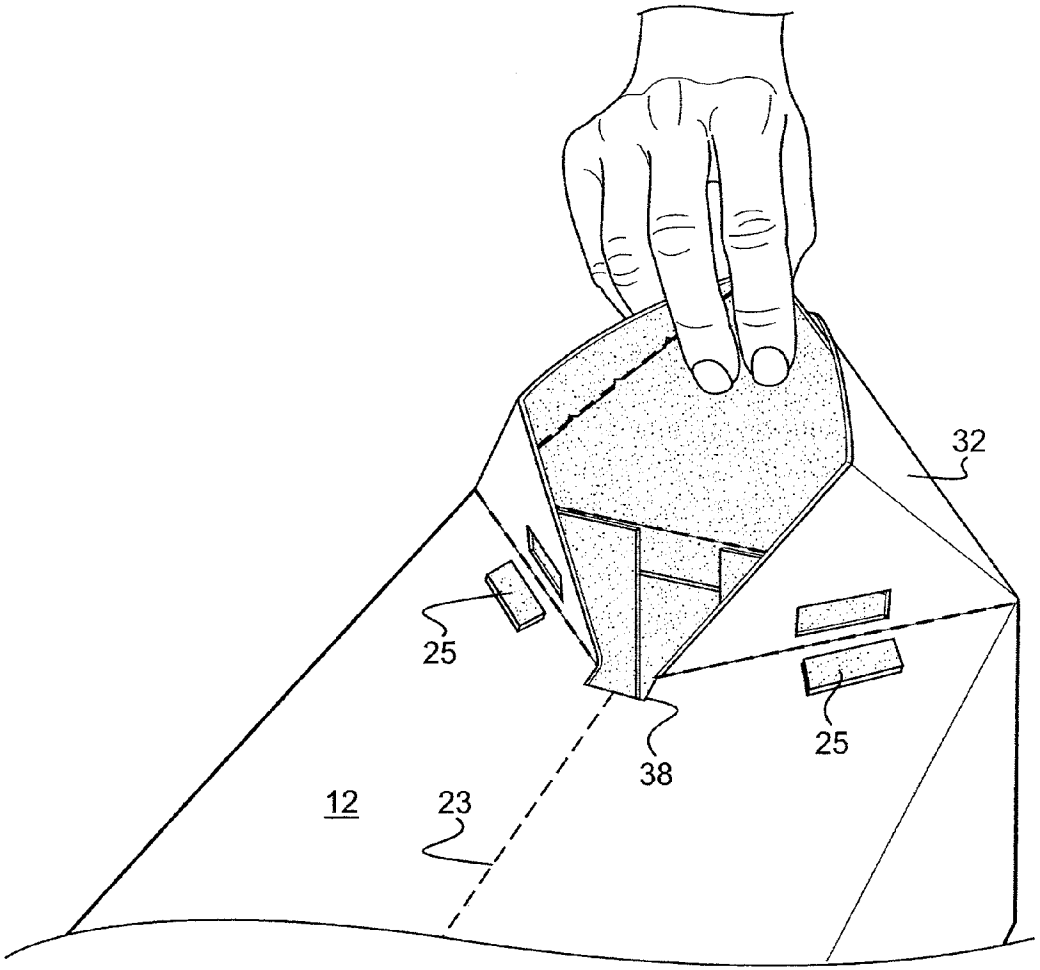
Figure 24:
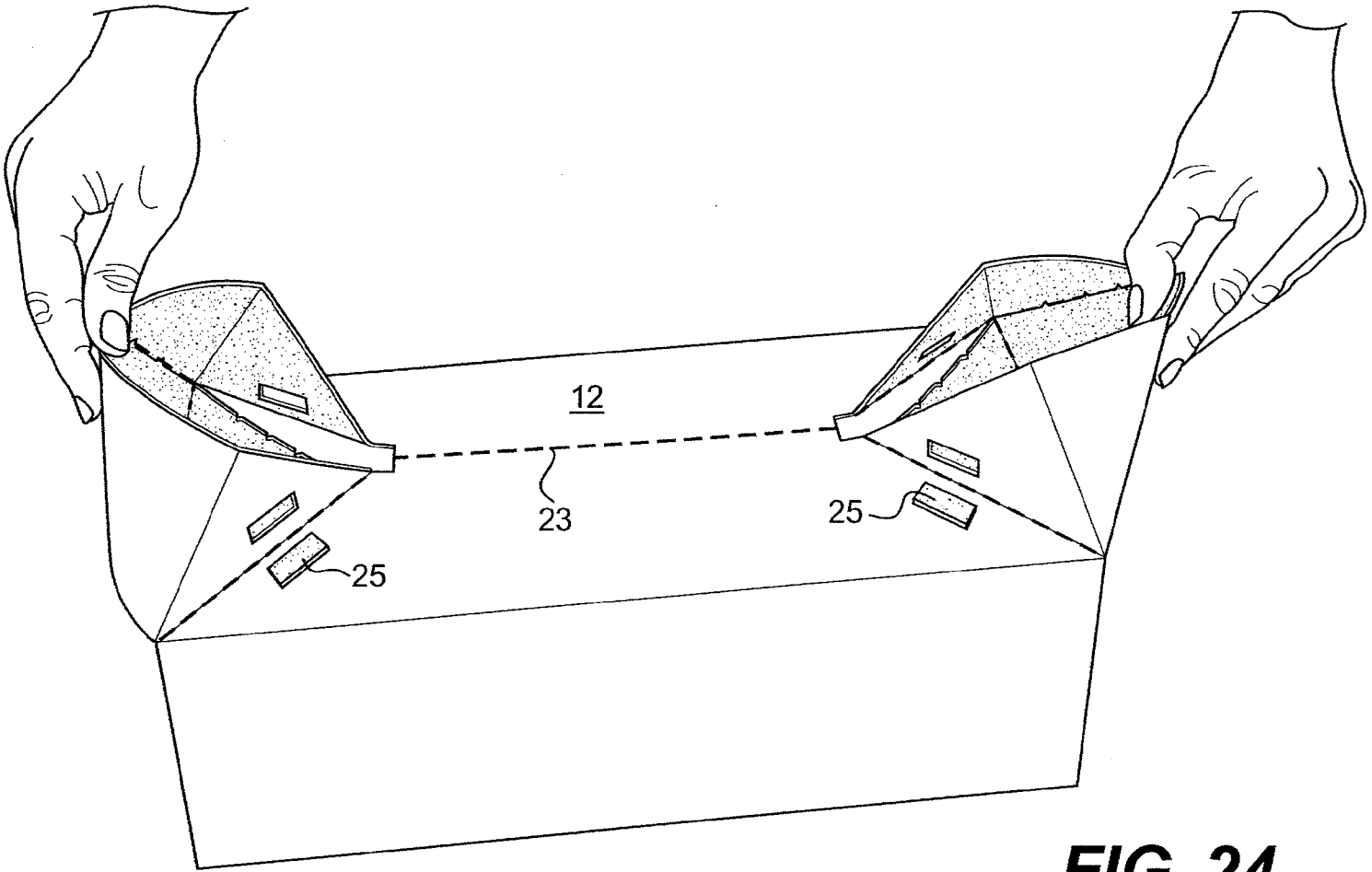

Next, the user pulls up and back on the flap 111, which begins to open up a chimney on one end of the carton (FIG. 22). As the flap 111 is pulled up, the partial cutouts 25, which are adhered to the outer top panel 12, tear out and remain attached to the top panel by virtue of the glue beneath. It will thus be seen that applying adhesive to the end portions of the top panel only in the areas where the partial cutouts overlie the outer top panel 12 serves to hold the flaps 111 down flat against the outer top panel 12 until it is desired to open the carton. The partial cutouts then tear out as flaps 111 are pulled up and back to allow the carton to be opened. FIG. 23 illustrates the flap 111 pulled completely up and back by a user to open up a chimney fully on one end of the outer top panel 12. The same procedure is then followed at the other end of the carton forming two open chimneys, one at each end of the outer top panel 12 (FIG. 24).

Figure 25:
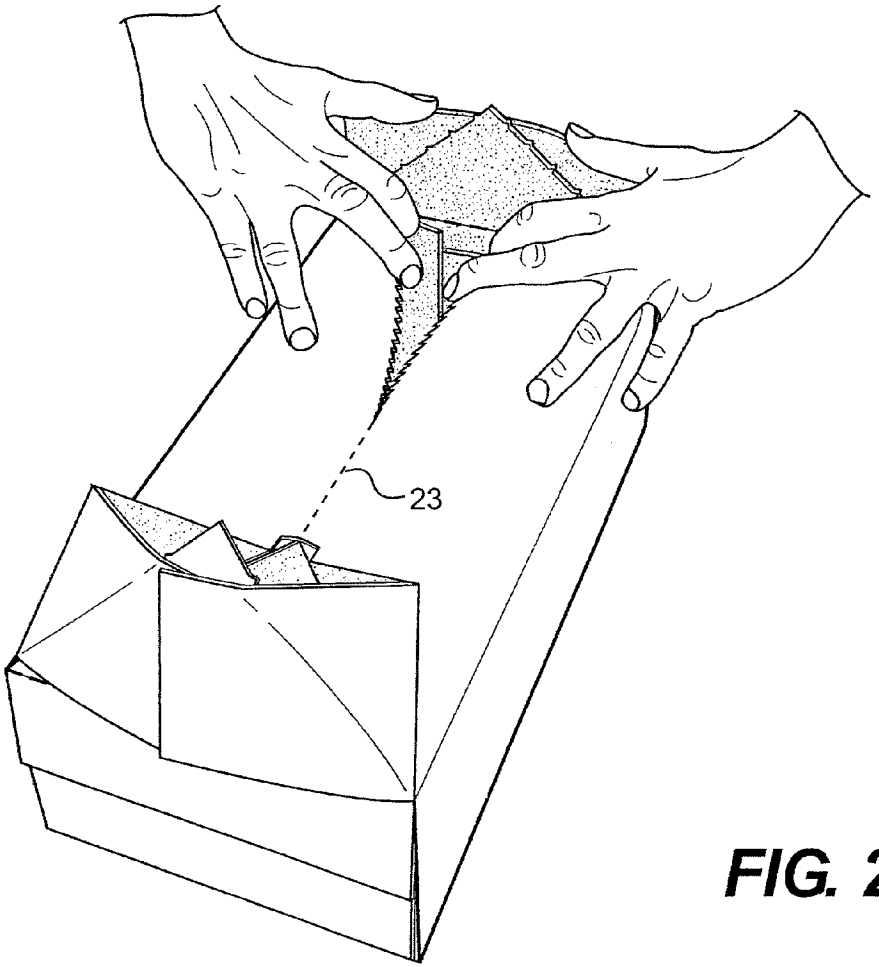
Figure 26:
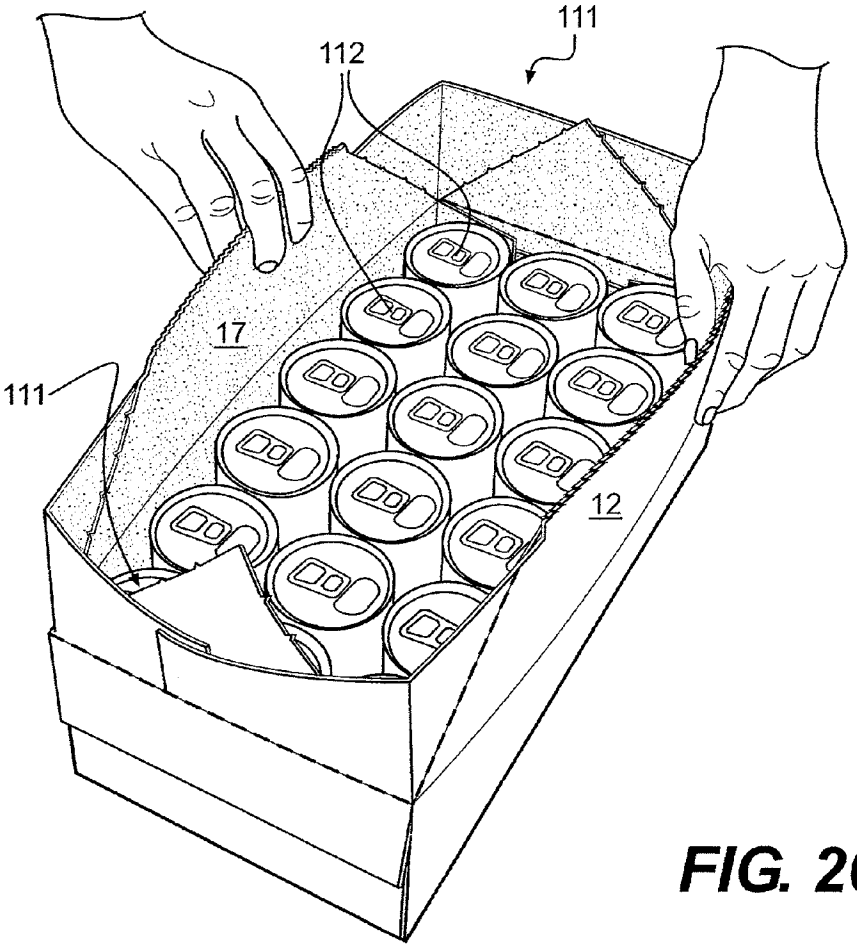

With the two chimneys opened up, the user then begins to tear the outer top panel 12 and the underlying inner top panel 17 along perforation line 23 in the outer top panel and perforation line 26 in the inner top panel (FIG. 25). The perforation lines are constructed so that tearing the panels along them is relatively easy for a typical user. When the outer and inner top panels 12 and 17 have been completely torn along their perforation lines 23 and 26 respectively, the user then pulls back the resulting partial panels to open up the carton completely revealing product within, which, in the preferred embodiment, is beverage cans 112 (FIG. 26). As shown in FIG. 26, when the carton is opened, the flaps 111 and the remnants of panels 12 and 17 extend upwardly a substantial distance above the tops of the beverage cans and form a containment skirt. A user can thus add ice to the open carton for cooling the beverage in the cans therein and the ice is contained by the containment skirt on top of and contacting the cans. Cooled beverage cans can then be obtained from the carton by digging through the ice until a can be located, grasped, and pulled from the ice.

As the ice in the carton begins to melt, water collects in the bottom of the carton. The unique design of the gussets 46, 52, 81, and 91 in the bottom corner portions of the carton, in conjunction with a water resistant coating on the inside of the carton, insures that, for at least the height of the gussets, there are no glued seams around the carton through which the collecting water can leak. Accordingly, water from the melting ice is retained in the bottom portion of the carton and does not leak onto a floor or other supporting surface. Thus, in this region, the carton may be said to be water-tight or liquid-tight. However, cartons of this invention may be formed of paperboard, which, if exposed to water or other liquids for extended periods of time may allow the liquid to leak through the wetted carton surfaces due to partial permeability of the carton material. Accordingly, "liquid-tight," "water-tight," and terms of similar import generally mean a region of a carton that is bounded by a continuous section of material or by a section without any glued seams through which liquid or fine particles might leak. These terms thus include cartons that may become partially water permeable over time due to prolonged exposure to water or other liquids.

In the above embodiments, the carton of the invention is described and shown (FIG. 26) in the context of containing 18 12-ounce beverage cans in a 6×3×1 configuration. Other arrangements of containers, packages, articles, and other items, however, can be accommodated within a carton constructed according to principles of the present invention. For example, the carton of this invention also will work satisfactorily if the carton is sized and shaped to hold articles in other configurations such as 4×3×1; 3×4×1; 2×4×1; 2×5×1; etc. The dimensions of the blank 11 also may be altered, for example, to accommodate various container forms such as, for instance, 16-ounce petaloid bottles.

The blank 11 may be formed, for example, from paperboard comprising clay coated newsprint (CCN), solid unbleached sulfate board (SUS), and other materials. In general, the blank may be constructed from paperboard having a caliper of at least about 14 so that it is heavier and more rigid than other paper. The blank also can be constructed of other materials such as cardboard, plastic sheet material, plastic coated paperboard, or any material having properties suitable for enabling the carton to function at least generally as described above. The blank can be coated such as, for example, with a clay coating. The clay coating may then be printed over with product information, advertising, and other information and/or images. The blank may be coated with a varnish to protect information printed on the blanks. The blank also may be coated, particularly on its interior surfaces, a moisture barrier layer comprising wax, varnish, or other appropriate materials. In this regard, such a moisture barrier layer is particularly preferred on the interior walls of the carton in the region of the carton that collects and holds water from melting ice. The blank also can be laminated or coated with one or more sheet-like materials at selected panels or panel sections.

In this specification, a "panel" or "flap" need not be flat or otherwise planar. A "panel" or "flap" can, for example, comprise a plurality of interconnected generally flat or planar sections. The preferred embodiment may be described as having one or more panels adhered together by glue. The term "glue" is intended to encompass all manner of adhesives commonly used to secure paperboard carton panels in place.

Certain fold lines or "creases" are described herein as including spaced cuts or "partial cuts" along their length to facilitate folding along the lines. If the cuts are below or adjacent to the bottom region of the carton intended to hold water, cuts that extend less than completely through the carton material may be used to prevent leakage along the creases. Alternatively, cuts may be omitted within or near the region of the container that is intended to hold water.

It will be understood by skilled artisans that while the present invention has been discussed with reference to exemplary embodiments, various additions, deletions, and modifications can be made to the illustrated embodiments without departing from the spirit and scope of the invention as set forth in the claims.

What is claimed is:

1. A carton comprising:

a bottom panel;

a first side panel connected to and extending upwardly from an edge of said bottom panel to a top edge;

a second side panel connected to and extending upwardly from an opposite edge of said bottom panel to a top edge;

an outside top panel connected to said top edge of said first side panel and being spaced from the bottom panel;

an inside top panel connected to said top edge of said second side panel and extending in spaced substantially parallel relationship to said bottom panel;

said outside top panel overlying and being substantially aligned with said inside top panel;

first and second flaps disposed at opposite end portions of said outside top panel;

longitudinal perforation lines formed in said outside and inside top panels extending between said first and second flaps; and oblique perforation lines extending from ends of said longitudinal perforation lines to corners of said outside and inside top panels;

movement of said first and second flaps up and away from said outside top panel separating said inside top panels along said oblique perforation lines; and separation of said inside and outside top panels along said longitudinal perforation lines opening said inside and outside top panels and said flaps to form a containment skirt extending upwardly from said carton.

2. A carton as claimed in claim 1 and wherein said first and second flaps are formed from tabs connected to said outside top panel.

3. A carton as claimed in claim 2 and wherein said tabs are separated by gaps.

4. A carton as claimed in claim 1 and further comprising end panels connected to said bottom panel, said first and second side panels, and said inside top panel, said end panels being folded inwardly to close respective ends of said carton.

5. A carton as claimed in claim 4 and wherein at least some of said end panels are formed with oblique fold lines that form gussets.

6. A carton as claimed in claim 5 and wherein said gussets are formed in bottom corner portions of said carton to define a region of said carton bounded by continuous material to facilitate the containment of liquid in said region.

7. A carton as claimed in claim 6 and further comprising a liquid-tight coating on inside surfaces of said carton at least within said region to prolong the containment of liquid.

8. A carton as claimed in claim 1 and wherein said carton is made of paperboard.

9. A carton blank comprising:

an outer top panel;

a first side panel foldably connected to said outer top panel;

a bottom panel foldably connected to said first side panel;

a second side panel foldably connected to said bottom panel;

an inner top panel foldably connected to said second side panel;

a perforation line formed along an intermediate portion of said outer top panel;

oblique cut-creases formed in said outer top panel extending from end portions of said perforation line to corners of said inner top panel;

a perforation line formed along an intermediate portion of said inner top panel;

oblique perforation lines formed in said inner top panel extending from end portions of said perforation line to corners of said inner top panel; and end panels connected to said bottom panel, said first and second side panels, and said inner top panel.

10. The carton blank of claim 9 and wherein at least some of said end panels are formed with oblique score lines defining gussets.

11. The carton blank of claim 10 and wherein said oblique score lines are formed on said end panels connected to said first and second side panels.

12. The carton blank of claim 9 and further comprising a pair of spaced apart tabs foldably connected to said outer top panel at each of its ends, each pair of tabs being separated by a gap.

13. The carton blank of claim 12 and wherein said gap extends into said outer top panel to a location beyond the intersections of the ends of said perforation line and said oblique cut-creases.

14. The carton blank of claim 13 and wherein said tabs form flaps on the ends of said outer top panel when said outer top panel is folded along said oblique cut-creases and said tabs are back folded along their foldable connection to said outer top panel.

15. A method of erecting a carton comprising the steps of:

obtaining a carton blank comprising:

an outer top panel, a first side panel, a bottom panel, a second side panel, and an inner top panel foldably connected one to the other along respective creases;

end panels on the first and second side panels, the bottom panel, and the inner top panel;

a pair of tabs separated by a gap and foldably connected to respective ends of the outer top panel;

perforation lines formed in the outer and inner top panels extending along mid portions thereof;

oblique perforation lines formed in the inner top panel extending from ends of the perforation line to corners of the inner top panel; and cut-creases formed in said outer top panel extending from ends of the perforation line to corners of the outer top panel;

folding the outer top panel along the oblique cut-creases to extend the tabs laterally outwardly from the outer top panel;

back folding the tabs along their connection to the outer top panel to overlap the ends of the tabs;

adhering the overlapping ends of the tabs together for form flaps at the end portions of the outer top panel; and folding and adhering remaining panels together to form a generally rectangular carton with the inner top panel underlying and substantially aligned with the outer top panel.

* * * * *